US006328490B1

(12) United States Patent
Narita et al.

(10) Patent No.: US 6,328,490 B1
(45) **Date of Patent: *Dec. 11, 2001**

(54) WINDING SHAFT AND A PRINTER USING THE SAME

(75) Inventors: Hiroshi Narita, Yamagata-mura; Masahiko Yamada, Omi-mura; Naoki Asai, Shiojiri; Kenichiro Arai, Shiojirishi, all of (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/583,190

(22) Filed: May 30, 2000

Related U.S. Application Data

(63) Continuation of application No. 09/131,603, filed on Aug. 10, 1998, now Pat. No. 6,106,175.

(30) Foreign Application Priority Data

Oct. 2, 1997 (JP) ..... 9-270244
Jul. 22, 1998 (JP) ..... 10-206782

(51) Int. Cl.[7] ..... B41J 11/26
(52) U.S. Cl. ..... 400/611; 242/571.6
(58) Field of Search ..... 400/586, 594, 400/611, 613, 619; 242/571, 571.6, 572, 573, 573.1, 573.2, 573.3, 573.4, 573.7, 573.9

(56) References Cited

U.S. PATENT DOCUMENTS

| | | | | |
|---|---|---|---|---|
| 2,156,089 | | 4/1939 | Hinnekens . | |
| 3,018,977 | | 1/1962 | Skallquist . | |
| 3,360,208 | * | 12/1967 | Winkler | 242/46.5 |
| 4,143,829 | | 3/1979 | Martin . | |
| 4,911,376 | * | 3/1990 | Thompson | 242/72.1 |
| 4,978,082 | * | 12/1990 | Sugioka et al. | 242/46.4 |
| 5,123,606 | * | 6/1992 | Braun et al. | 242/72.1 |
| 5,460,339 | * | 10/1995 | Drew | 242/572 |
| 5,547,297 | | 8/1996 | Aizawa et al. . | |

FOREIGN PATENT DOCUMENTS

| | | |
|---|---|---|
| 2 612 904 | 9/1988 | (FR) . |
| 2 103 761 A | 2/1983 | (GB) . |
| Sho. 55-66156 | 5/1980 | (JP) . |

* cited by examiner

*Primary Examiner*—Ren Yan
(74) *Attorney, Agent, or Firm*—Nixon & Vanderhye P.C.

(57) ABSTRACT

A winding shaft, for use in a printer allows a wound recording paper to be easily removed therefrom. The winding shaft includes a shaft main body, a winding portion and a support-removing member. The winding portion, which sandwiches the shaft main body, winds the recording paper therearound. The shaft main body includes a pair of support-removing members, which respectively project from the shaft main body. The two support-removing members are respectively supported on the two side portions of the shaft main body in such a manner that they can be freely rotated about their respective support shafts. A tension-coiled spring is bridgingly disposed between the two support-removing members, so that the two support-removing members remain in standing positions when no external force is applied to them. If the recording paper is lightly rotated in a direction opposite to the winding direction of the recording paper, then the two support-removing members are brought down in the same direction due to an external force applied thereto from the innermost peripheral recording paper. As a result, the innermost peripheral recording paper is loosened, that is, is caused to float loosely from the outer peripheral surface of the shaft main body, thereby enabling the removal of the recording paper from the winding shaft.

16 Claims, 22 Drawing Sheets

WINDING SHAFT AND A PRINTER USING THE SAME

This is a continuation of allowed application U.S. Ser. No. 09/131,603, filed Aug. 10, 1998, now U.S. Pat. No. 6,106,175, claiming the benefit of Japanese priority applications P. Hei. 9-270244, filed Oct. 2, 1997, and P. Hei. 10-206782, filed Jul. 22, 1998.

BACKGROUND OF THE INVENTION

1. Field of the Invention

The present invention relates to a winding shaft for winding therearound a recording medium such as journal paper or the like, and a printer using such a winding shaft.

2. Description of the Related Art

Conventionally, for the purpose of sales and inventory management in a store or the like, there has been a requirement to keep journal paper on which selling prices, names of articles and the like are printed. Therefore, a printer that is structured such that it winds the printed journal paper around a winding shaft has been proposed. An example printer of this type is shown in FIG. 26.

Referring to FIG. 26, this printer 101 is a dot impact printer, which is incorporated into a cash register or the like. The printer 101 includes printer main body 103, a clamshell mobile part 104, and a winding mechanism 105. A ribbon cassette 102 can be removably mounted on the printer main body 103. The clamshell mobile part 104 is movably supported at a position on the printer main body 103 located near the rear portion of the upper portion of the printer main body 103. The winding mechanism 105 is disposed in the rear of the printer main body 103. Recording paper 106, such as journal paper printed by a print head (not shown) or the like, is fed out upwardly of the clamshell mobile part 104 by a paper feed mechanism 107, is then passed through a plane portion 108*a* of a writing base 108 for print correction, and is finally wound around a winding shaft 109 of the winding mechanism 105.

The winding shaft 109 is rotatably supported in a cantilevered manner while a disk-shaped winding flange 111 is fixed to a portion of the winding shaft 109 on the support plate 110 side thereof. Also, a driving gear 112 is fixed to the leading end portion of the winding shaft 109 on the support plate 110 side thereof. The winding shaft 109 can be driven or rotated via meshing engagement between a gear train 114 and the gear 112 fixed to the winding shaft 109. The gear train 114 can be driven or rotated by a winding belt 113 linked to and movable with the paper feed mechanism of the printer main body 103.

In the printer 101 of this type, it is necessary to remove the recording paper 106 from the winding shaft 109 after it is wound therearound. However, because the recording paper 106 is wound tightly, it is not easy to remove the recording paper 106. That is, the recording paper 106 sticks to the winding shaft 109, resulting in the center of the recording paper 106 becoming shaped like bamboo shoots.

In order to solve the above problem, conventionally there has been proposed a paper-winding device structured such that the outside diameter of a winding shaft can be changed. (For an example, see Japanese Utility Model Publication No. 55-66156 of Showa). However, in this conventional device, it is necessary to apply an external force to the winding shaft in the axial direction thereof in order to change the outside diameter of the winding shaft. Since this external force is different from a force required to remove the recording paper, the operation of this conventional device is troublesome.

SUMMARY OF THE INVENTION

The present invention aims at eliminating the technical problems found in the above-mentioned conventional winding shaft and paper-winding device. Accordingly, it is an object of the present invention to provide a winding shaft that allows the recording paper wound therearound to be removed through a simple operation, and to provide a printer using such a winding shaft.

It is another object of the present invention to provide a winding shaft that not only allows a winding mechanism including an existing winding shaft to maintain its winding property, but also permits the recording paper wound thereon to be removed by a simple operation.

In order to attain the above objects, there is provided a winding shaft having a shaft main body, a winding portion and a support-removing member. The winding portion, which sandwiches the shaft main body, winds the recording medium therearound. The support-removing member is disposed on the shaft main body and is movable between a first position and a second position. The first position is located in the outer periphery of the winding portion such that the support-removing member projects beyond the outer periphery of the winding portion so as to allow the support-removing member to be in contact with the recording medium. The second position is located nearer to the axis of the main body than the first position. The support-removing member is movable from the first position to the second position by a frictional force produced when the recording medium in contact the support-removing member is moved.

If the recording medium wound around the winding portion is moved in a given direction, then the support-removing member is moved from the first position to the second position due to an external force used to pull out the recording medium, thereby reducing the winding diameter of the recording medium. As a result, the innermost peripheral recording medium wound around the winding portion is caused to float from the outer periphery of the winding portion. That is, the innermost peripheral recording medium is loosened with respect to the outer periphery of the winding portion. This is done so that the recording medium can be easily removed while remaining in a roll from the winding shaft, without the possibility of the recording medium portions being shifted from each other.

The support-removing members may be moved from the first position to the second position in a direction selected from a group consisting of a direction in which the recording medium wound around the winding portion is rewound, the axial direction of the winding portion, or a combination of the rewinding direction and the axial direction.

If the wound recording medium is rotated in the peripheral direction in which the recording medium is rewound, or if the wound recording medium is moved in the axial direction of the winding portion, or if the wound recording medium is rotated in the peripheral direction of the winding portion or is moved in the axial direction thereof, then the innermost peripheral recording medium wound around the winding shaft is caused to float from the outer periphery of the winding portion. That is, the innermost peripheral recording medium is loosened with respect to the outer periphery of the winding portion, so that the recording medium can be easily removed from the winding shaft.

The winding shaft of the present invention may further include a sleeve-shaped operation member disposed on the periphery of the winding portion in such a manner that not only is it movable relative to the winding portion, but also the recording medium can be wound therearound. When the operation member moves, the operation member applies an external force to the support-removing member in a direction to move the support-removing member from the first position to the second position.

When removing the recording medium, the operation member is moved together with the recording medium, and external forces are applied to the support-removing members from not only the recording medium but also the operation member. This makes it possible to move the support-removing members more smoothly and thus turn the recording medium into its loosened state.

Further, the support-removing members are located at the first position when no force is applied thereto. That is, when winding the recording medium around the winding shaft, the support-removing members can not be moved from the first position to the second position by the recording medium. On the other hand, when removing the recording medium, the support-removing members can be smoothly moved, and the recording medium can become loose.

The invention may further include a winding flange and a recording medium. The winding flange is disposed at one end of the winding shaft and is contactable with a side end portion of the recording medium so as to guide the recording medium. The recording medium support portion is disposed on the outer periphery of the winding portion at a position located nearer to the winding flange than the support-removing member mounted on the shaft main body, and also along the axial direction of the winding portion from the support-removing member. The recording medium support portion is contactable with the recording medium. Additionally, the recording medium support portion is structured such that the diameter thereof from the axis of the winding shaft is substantially equal to the diameter of the support-removing member when the support-removing member is located at the first position and contactable with the recording medium.

That is, when winding the recording medium around the winding shaft, because the recording medium is wound substantially in parallel to the axis of the winding shaft by the recording medium support portion and support-removing member, the delivery of the recording medium up to the winding shaft can be stabilized. As a result, it is possible to provide a winding shaft that prevents the recording medium from increasing in bulk and is improved in winding quality.

Also, the support-removing member mounted on the shaft main body consists of a plurality of support-removing members respectively arranged along the axial direction of the winding portion. Because the recording medium can be wound substantially in parallel to the axis of the winding shaft, and a plurality of support-removing members are arranged in the axial direction of the winding portion, the recording medium is caused to float loosely from the outer periphery of the winding portion in parallel to the axis of the winding shaft. As a result, the recording medium can be more easily and efficiently removed from the winding shaft.

The present invention further comprises a printer, which includes a print head, a paper feed mechanism, a winding shaft and a winding shaft mechanism. The print head, which is mounted on a main body of the printer, is for printing a recording medium. The paper feed mechanism sequentially and longitudinally feeds the recording medium printed by the print head. The winding shaft is structured as described above. The winding shaft mechanism is structured such that it allows the recording medium fed by the paper feed mechanism to be wound around the winding shaft. That is, the printed recording medium wound around the winding shaft can be removed therefrom by a very simple operation, which makes it possible to provide a printer which is highly efficient in replacing the recording medium.

DETAILED DESCRIPTION OF THE PREFERRED EMBODIMENTS

Now, a detailed description will be given below of the preferred embodiments of a winding mechanism and a printer using the winding mechanism according to the invention with reference to the accompanying drawings.

Figure 1:
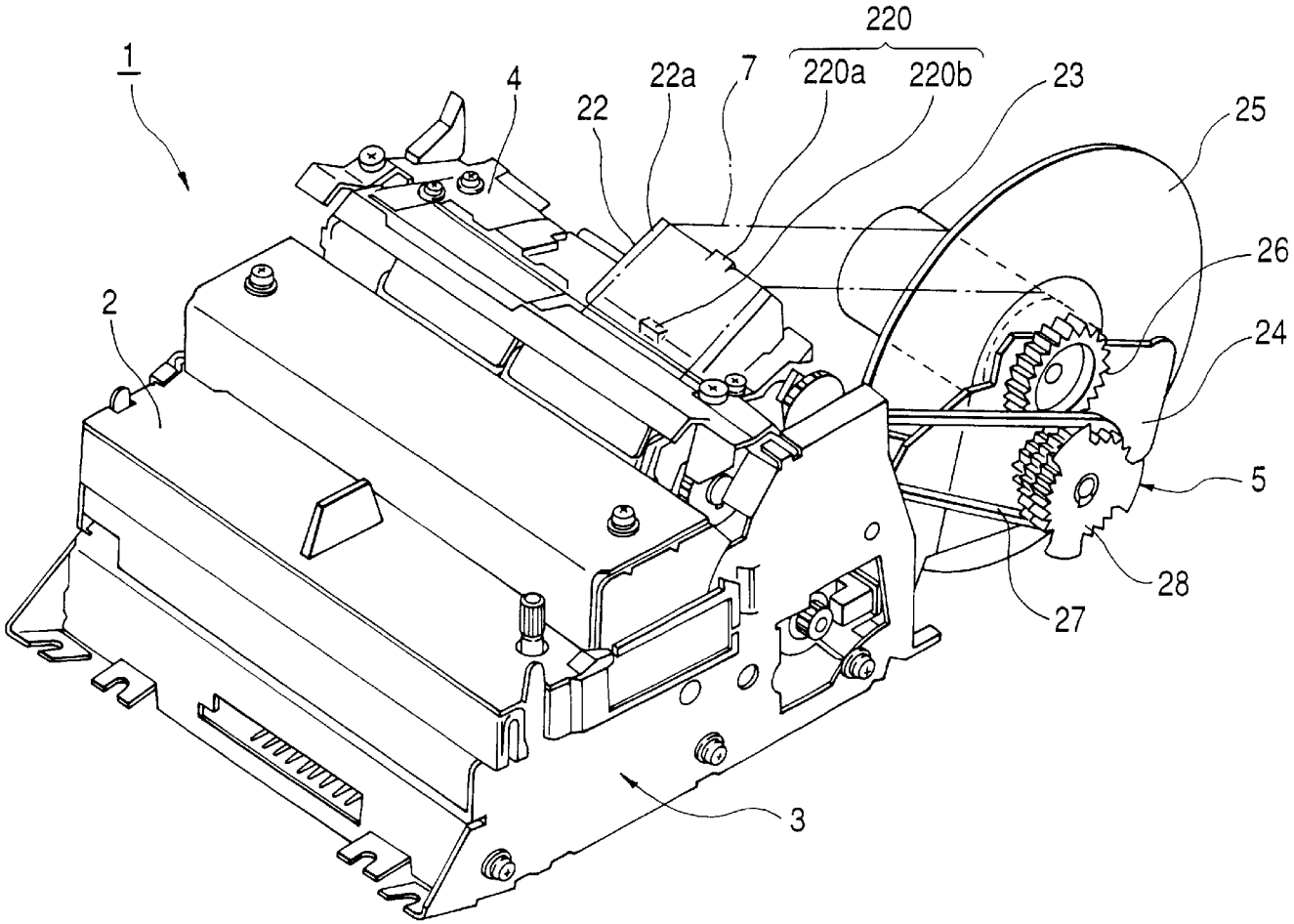
FIG. 1 is a perspective view of the whole structure of a printer according to the present invention.
Figure 2:
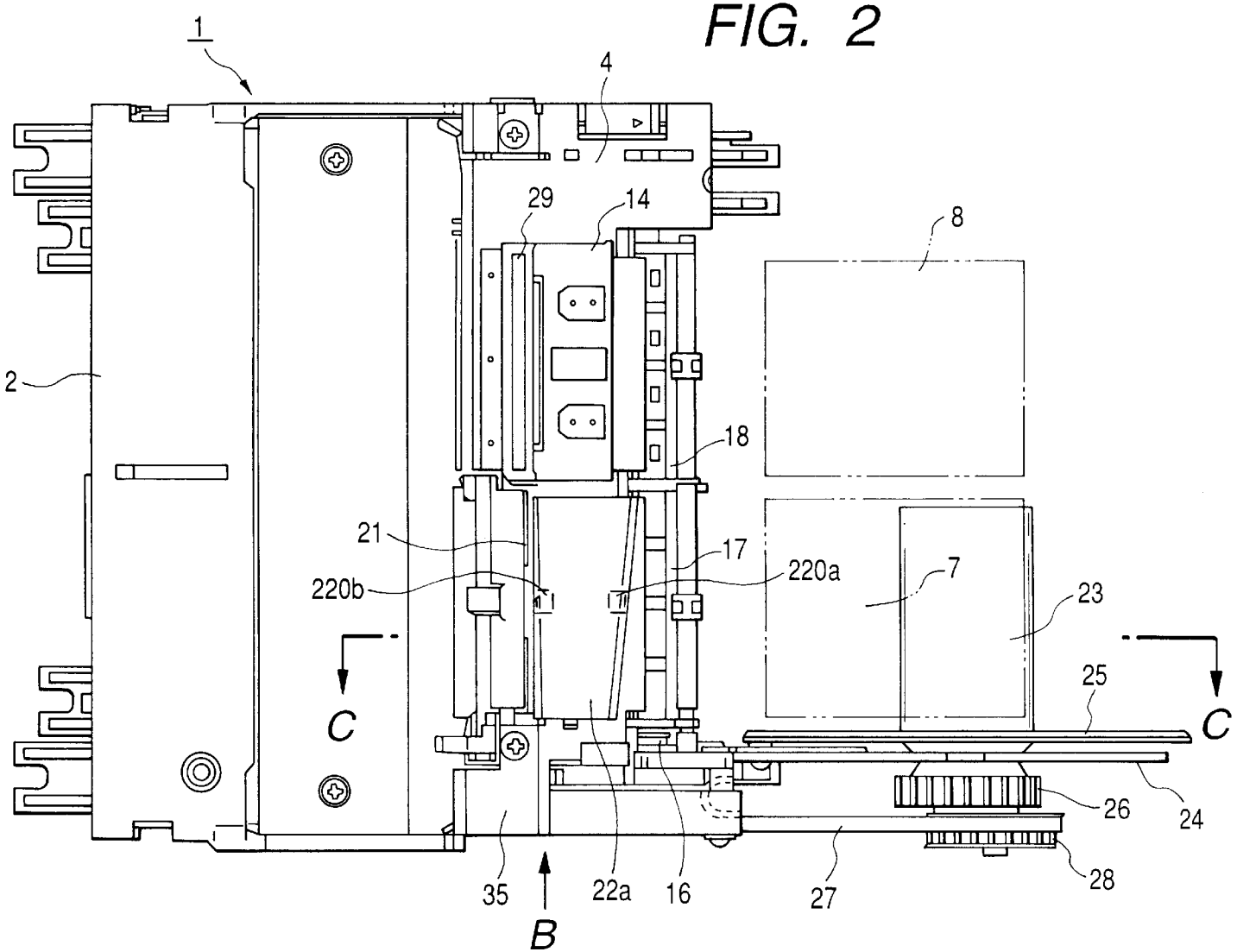
FIG. 2 is a plan view of the printer shown in FIG. 1.
Figure 3:
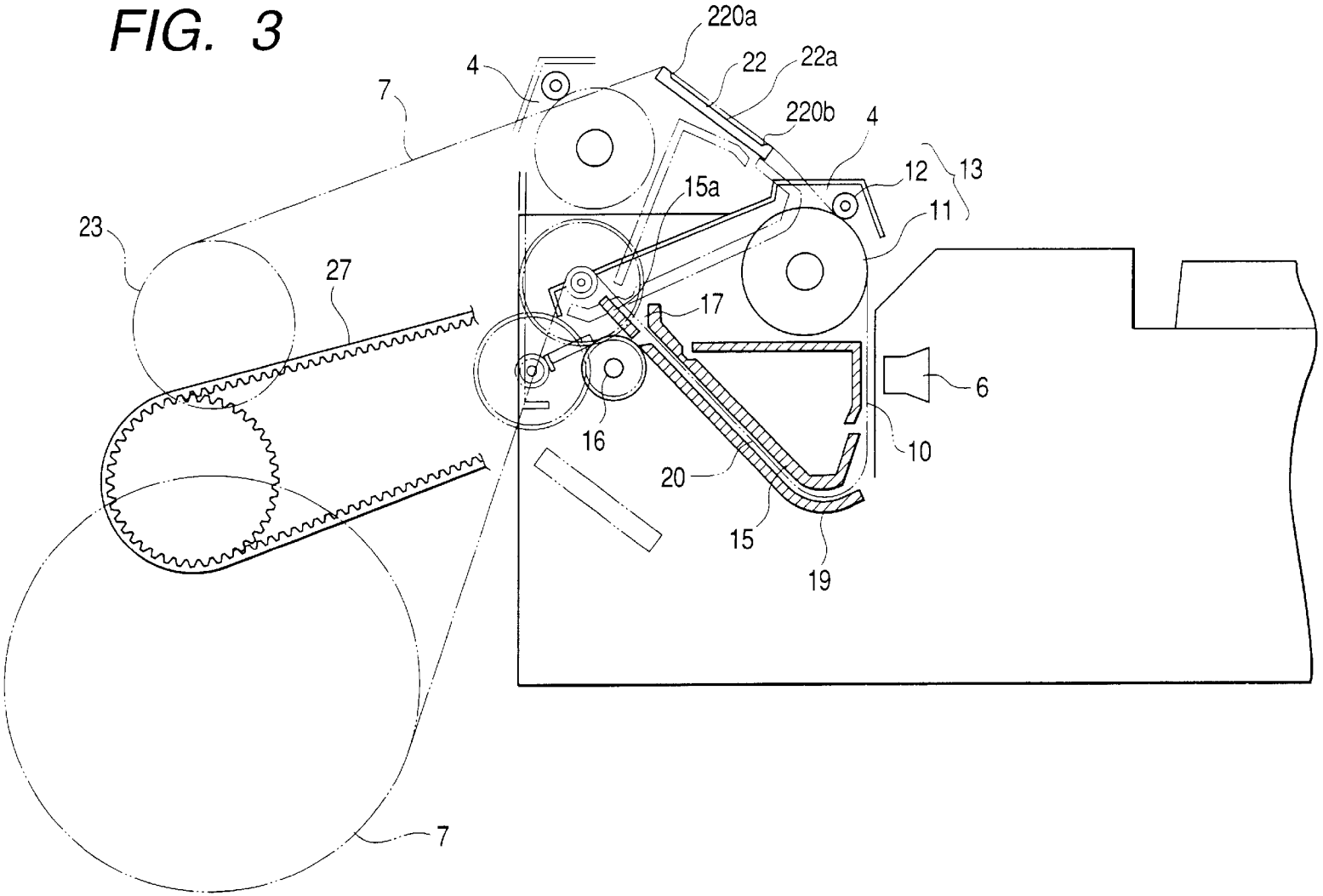
FIG. 3 is a section view taken along the line C—C shown in FIG. 2.
Figure 4:
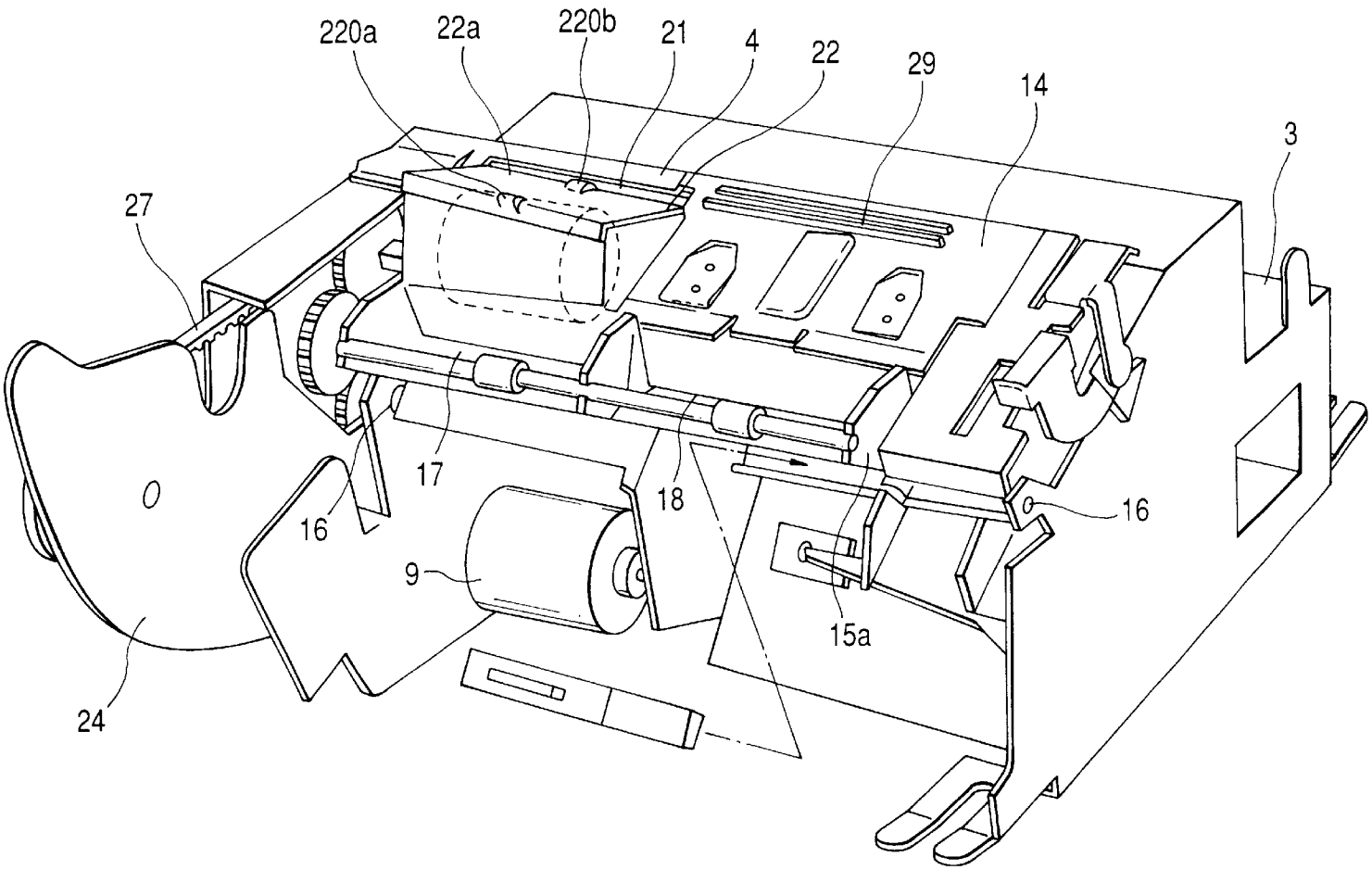
FIG. 4 is a perspective view of the rear portion of the printer shown in FIG. 1.

FIG. 1 is a perspective view of the whole structure of an embodiment of a printer according to the present invention. FIG. 2 is a plan view of the printer. FIG. 3 is a section view taken along the line C—C shown in FIG. 2. FIG. 4 is a perspective view of the rear portion of the printer shown in FIG. 1.

As shown in FIG. 1, a printer 1 according to the present embodiment is a dot impact printer that is incorporated into a cash register or the like. The printer 1 includes a printer main body 3, a clamshell mobile part 4, and a winding mechanism 5. A ribbon cassette 2 may be removably mounted onto the printer main body 3. The clamshell mobile part 4 is movably supported at a position on the printer main body 3 that is located near the rear portion of the upper portion of the printer main body 3. The winding mechanism 5 is disposed in the rear of the printer main body 3.

The printer main body 3 includes a print mechanism (not shown), a paper feed mechanism (not shown), and a drive motor (see FIG. 4). The print mechanism is for reciprocating a carriage (not shown) carrying a print head 6 (see FIG. 3) thereon in the width direction of two sheets of recording paper 7 and 8 (see FIG. 2). The paper feed mechanism (not shown) is for feeding the recording paper 7 and 8 to a print position where the recording paper is printed by the print head 6. The drive motor 9 (see FIG. 4) is a drive source to be used in common with the print and paper feed mechanisms.

The clamshell mobile part 4 includes a platen 10, a paper feed mechanism 13, an auto-cutter mechanism 14, and an upper side paper guide 15. The paper feed mechanism 13 is composed of a paper feed roller 11 and a paper hold roller 12 for pressing the recording paper against the paper feed roller 11. The auto-cutter mechanism 14 is disposed on the upper portion of the paper feed mechanism 13, and is for cutting the receipt sheet 8. The upper side paper guide 15 is formed of resin, and there are mounted other composing elements with the upper side paper guide 15 as a base thereof.

Here, in the upper side paper guide 15, there is formed a projection portion (not shown) which is engageable with a hole (not shown) formed in the printer main body 3. When the projection portion is engaged with the hole, there is formed a rotation center shaft 16 for the clamshell mobile part 5.

As shown in FIGS. 3 and 4, the clamshell mobile part 4 is mounted at a position located in the upper rear portion of the printer main body 3 in such a manner that it can be rotated about the rotation center shaft 16. The clamshell mobile part 4 is mounted in order to expose a paper passage 20. The paper passage 20 is defined by the upper side paper guide 15 and lower side paper guide 19, and extends from paper feed openings 17 and 18 formed in the rear portion of the printer main body 3 to the print position. In FIG. 3, a solid line shows the closed state of the clamshell mobile part 4, whereas a virtual line (a two-dot chained line) shows the open state of the clamshell mobile part 4.

As shown in FIG. 2, the two paper feed openings 17 and 18 are arranged side by side on the left and right sides of the rear portion of the clamshell mobile part 4. To the paper feed opening 17, there is supplied the recording paper 7 such as the journal paper or the like to be stored on the storage side for sales and inventory management. As shown in FIG. 3, the recording paper 7 is disposed in the lower rear portion of the printer main body 3. Further, the leading end portion of the recording paper 7 can be fed from the paper feed opening 17 to reach the print position through the paper passage 20. After being printed, the recording paper 7 is sequentially fed out from a discharge opening 21, is passed through the writing base 22 provided upwardly of the clamshell mobile part 4, and is then taken up around the winding shaft 23 of the winding mechanism 5.

Figure 26:
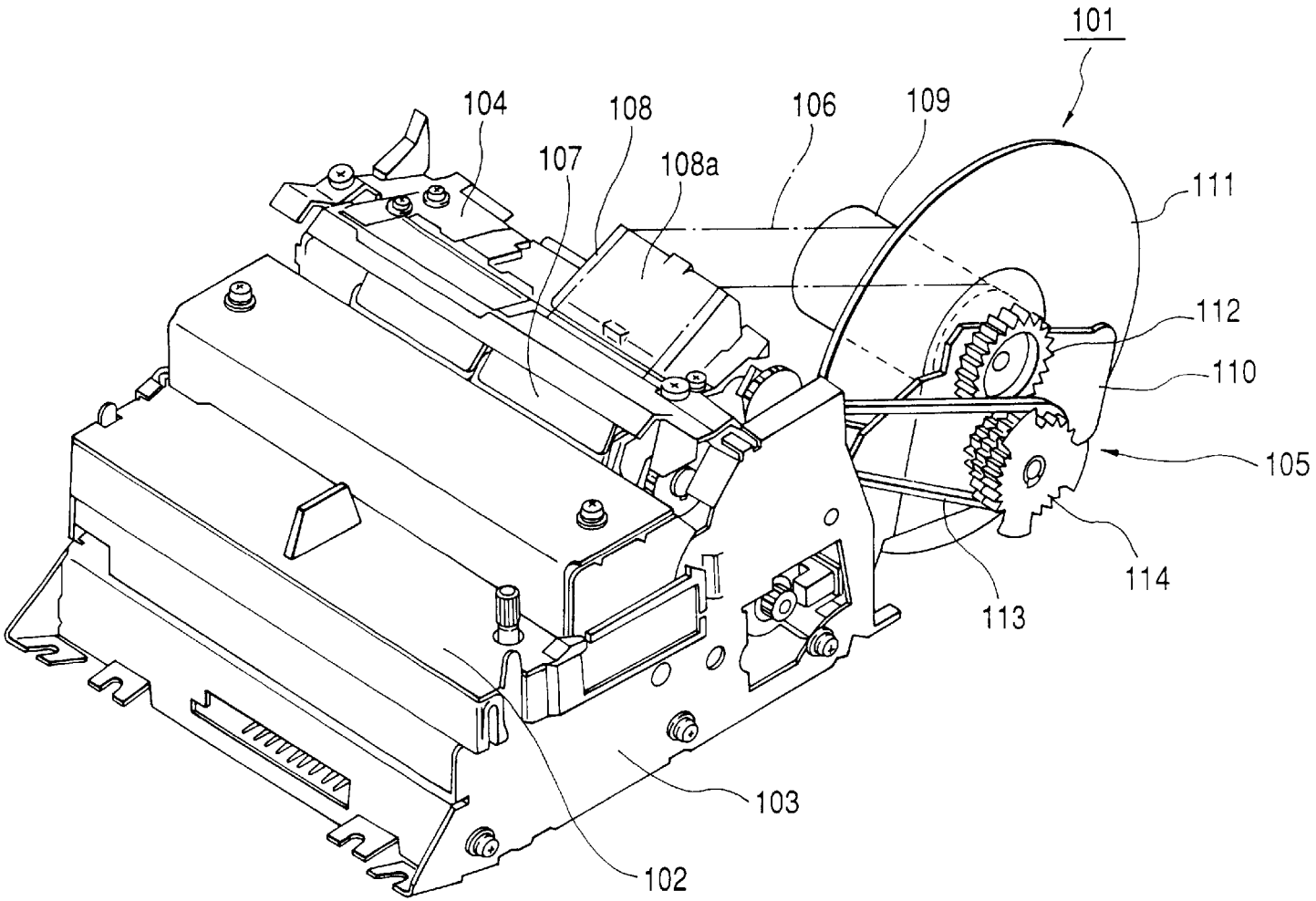
FIG. 26 PRIOR ART
FIG. 26 is a perspective view of the whole structure of an embodiment of a conventional printer.

The winding shaft 23 is rotatably supported in a cantilevered manner on a support plate 24, which is fixed to the rear portion of the printer main body 3. A disk-shaped winding flange 25 is formed integrally with the portion of the winding shaft 23 that is located on the support plate 24 side thereof. A gear 26 for driving is formed integrally with the leading end portion of the winding shaft 23 on the support plate 24 side thereof. The winding shaft 23 can be driven or rotated via meshing engagement between a gear train 28 and the gear 26 formed integrally with the leading end portion of the winding shaft 23. The gear train 28 can be driven or rotated by a winding belt 27, which is linked to and movable with the paper feed mechanism 13 of the printer main body 3. Also, the winding shaft 23 is inclined so that the length of the paper feed passage of the end portion thereof on the side where the winding flange 25 of the winding shaft 23 is not provided is longer than the length of the paper feed passage of the end portion thereof on the side where the winding flange 25 is provided. In this case, as will be discussed later, since a separate measure is taken to prevent the meandering of the recording paper, the angle of inclination of the winding shaft 23 may be set to be smaller than in the conventional structure shown in FIG. 26.

To the paper feed opening 18, there is supplied the recording paper 8 such as the receipt sheet or the like which is to be given to a customer. The recording paper 8, similar to the recording paper 7, passes through the paper passage 20 and arrives at the print position. After being printed, the recording paper 8 is fed out upwardly from a receipt discharge opening 29 formed in the upper surface of the clamshell mobile part 4.

Figure 5:
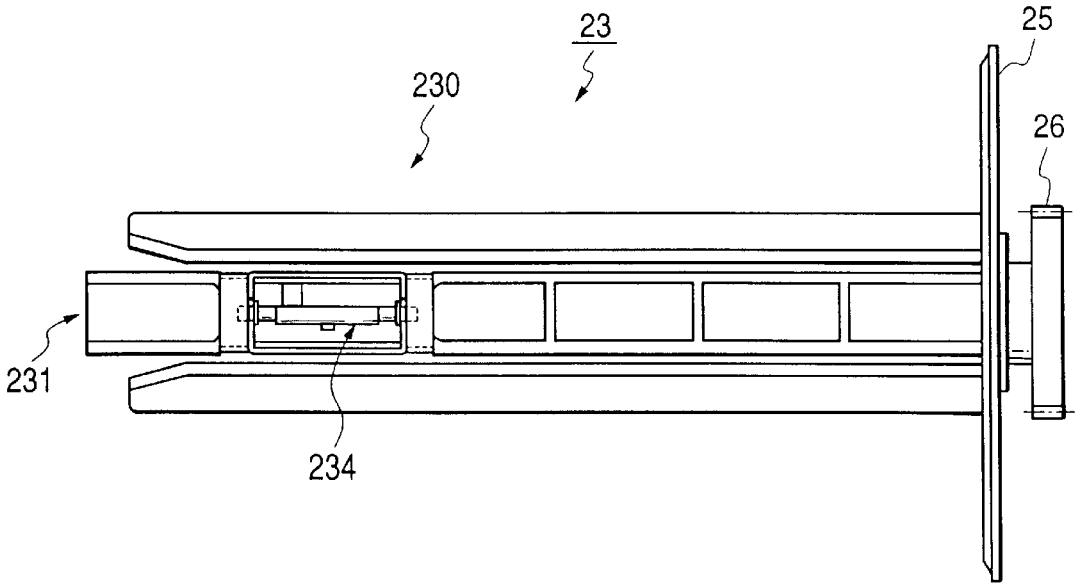
FIG. 5 is a plan view of the outer appearance of a first embodiment of a winding shaft according to the present invention.
Figure 6:
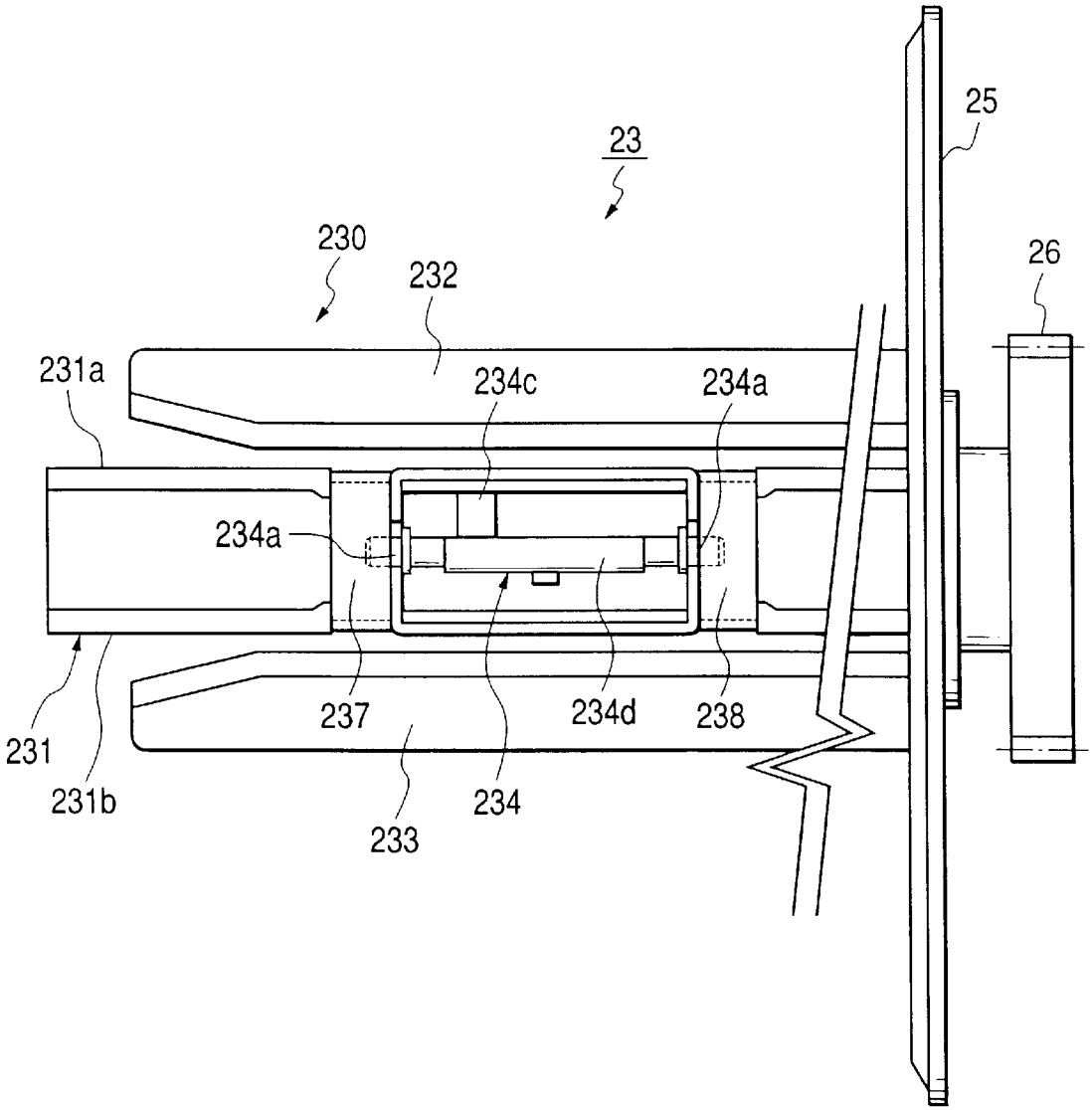
FIG. 6 is a detailed plan view of the first embodiment of the winding shaft.
Figure 7:
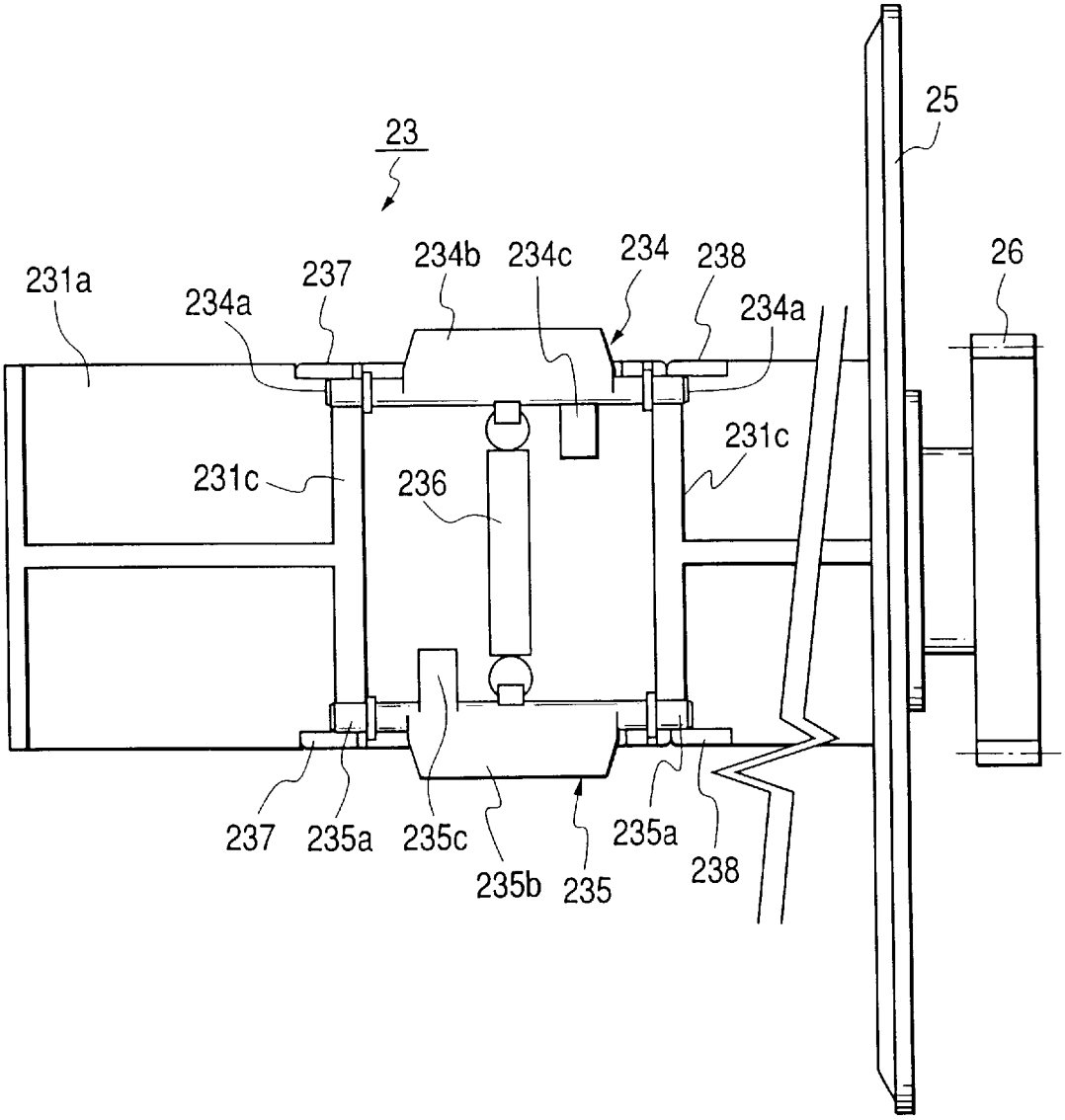
FIG. 7 is a schematic view of the internal structure of the first embodiment of the winding shaft.
Figure 8A:
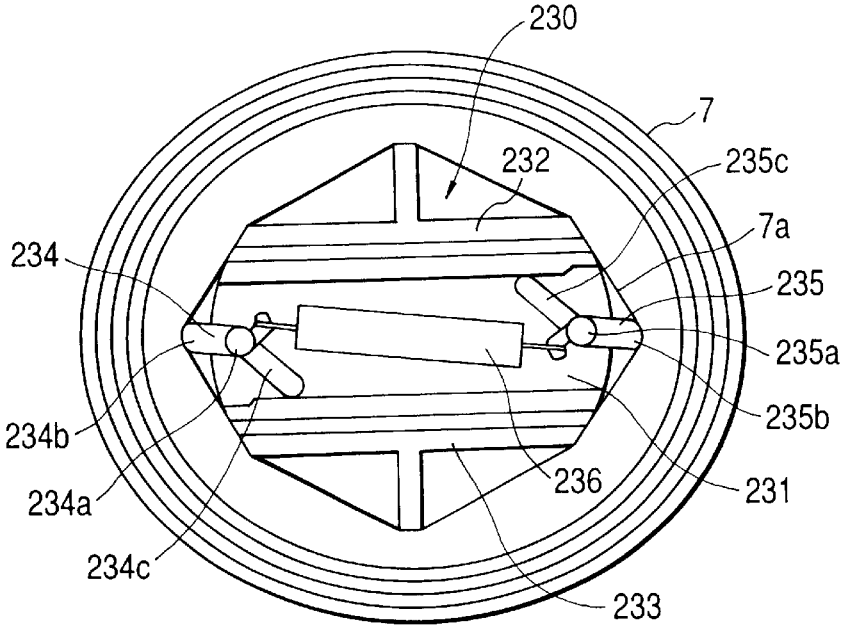
FIG. 8A is an explanatory view of the principle operation of the first embodiment of the winding shaft, showing a state thereof in which recording paper is wound around the present winding shaft.
Figure 8B:
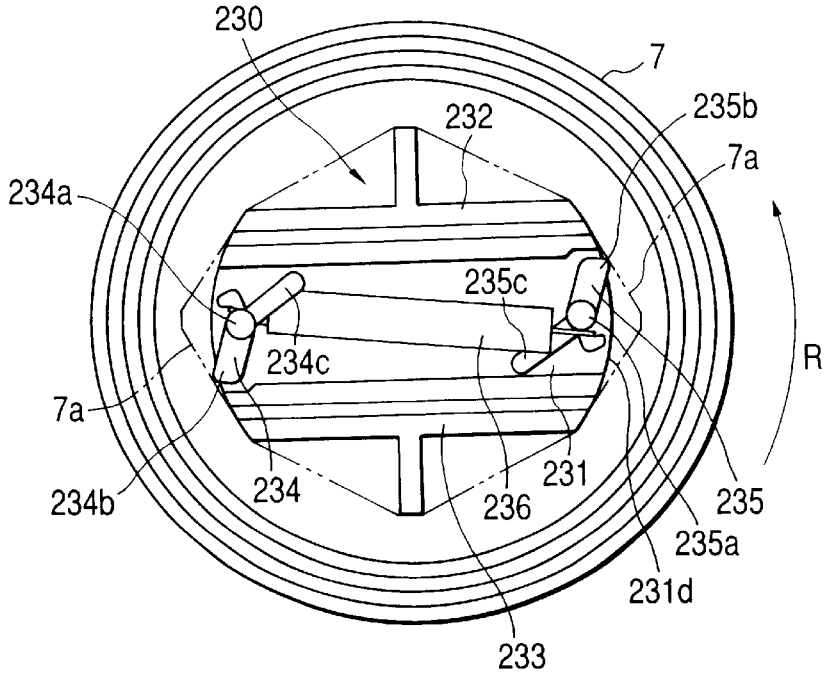
FIG. 8B is an explanatory view of the principle operation of the first embodiment of the winding shaft, showing a state thereof in which support-removing members are brought down.
Figure 9:
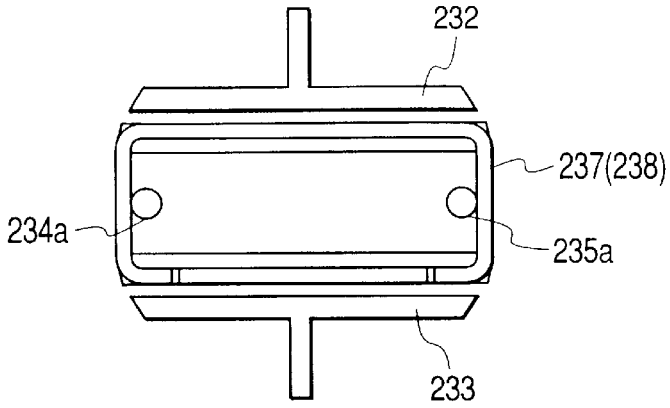
FIG. 9 is a structure view of the neighboring portion of a holding member employed in the first embodiment of the winding shaft.

FIG. 5 is a plan view of the outer appearance of a first embodiment of a winding shaft according to the present invention. FIG. 6 is a detailed plan view of the present embodiment. FIG. 7 is a schematic view of the internal structure of the present embodiment. FIG. 8A is an explanatory view of the principle operation of the present embodiment, showing a state thereof in which a support-removing member is situated at its first position and the recording paper is wound on the winding shaft. FIG. 8B is an explanatory view of the principle operation of the present embodiment, showing a state thereof in which the support-removing member is situated at its second position (i.e., the support-removing member is brought down). FIG. 9 is a structure view of the neighboring portion of a holding member provided in the present embodiment.

The winding shaft 23 according to the present embodiment is formed of resin material or the like. In particular, the winding shaft 23 includes a shaft main body 231 structured such that it encloses the rotation center of the winding shaft 23, and a pair of winding portions 232 and 233 formed such that they sandwich the shaft main body 231 between them. The shaft main body 231 and winding portions 232, 233 cooperate in forming a winding shaft portion 230. Here, the winding portions 232, 233 are disposed such that they surround the shaft main body 231, while the respective surfaces of the winding portions 232 and 233 are formed in an arc-surface manner. However, the surfaces are not always limited to such an arc surface shape.

The shaft main body 231 includes a pair of mutually opposed square-shaped plate members 231*a* and 231*b* that are reinforced by a rib 231*c* (see FIG. 7) disposed in the middle portion thereof. A pair of support-removing members 234 and 235 are disposed on the rib 231*c*, and are supported respectively on the two side portions of the shaft main body 231 in such a manner that they can be freely rotated about their respective support shafts 234*a* and 235*a*. As shown in FIG. 7, between the support-removing members 234 and 235, there is provided a tension-coiled spring 236. When no external force is applied to the support-removing members 234 and 235, the tension-coiled spring 236 rotates in the direction opposite to an arrow R direction. As a result, the securing projections 234*c* and 235*c* of the support-removing members 234 and 235 are butted against the inner surface of the winding shaft 231, and the two support-removing members 234 and 235 are respectively caused to stand up, as shown in FIG. 8A. Also, the support portions 234*b* and 235*b* of the support-removing members 234 and 235 are caused to project out from the side portions of the shaft main body 231. Due to this structure, the two support-removing members 234 and 235 are constructed such that they can be brought down only in the direction opposite to the winding direction of the recording paper 7 from such stand-up positions as shown in FIG. 8B. In order to prevent the two support-removing members 234 and 235 from slipping off the shaft main body 23i, as shown in FIGS. 5, 6, and 9, they are respectively held by a pair of holding members 237 and 238 each having a substantially U-shaped section.

In the thus structured present embodiment, if the recording paper 7 is taken up, as shown in FIG. 8A, the recording paper 7 is taken up in such a manner that the two support-removing members 234 and 235 respectively stand up. That is, the two support-removing members 234 and 235 respectively project out from the shaft main body 231.

When the recording paper 7 is to be removed from the winding shaft 23, the winding shaft 23 is first removed from the printer 1. The recording paper 7 is then gripped by hand and rotated lightly with respect to the winding shaft 23 in the direction opposite to the winding direction (i.e., in the arrow R direction). The two support-removing members 234 and 235 are then caused fall down in the arrow R direction due to an external force (i.e., friction force) from the innermost peripheral portion 7*a* of the recording paper 7. See FIG. 8B. As a result, the innermost peripheral recording paper 7*a* wound around the winding shaft portion 230 is caused to float from the outer peripheral surface 231*d* of the shaft main body 231. That is, the recording paper 7*a* is loosened with respect to the outer peripheral surface 231*d*, so that the wound recording paper 7 can be easily removed from the winding shaft 23.

Figure 10:
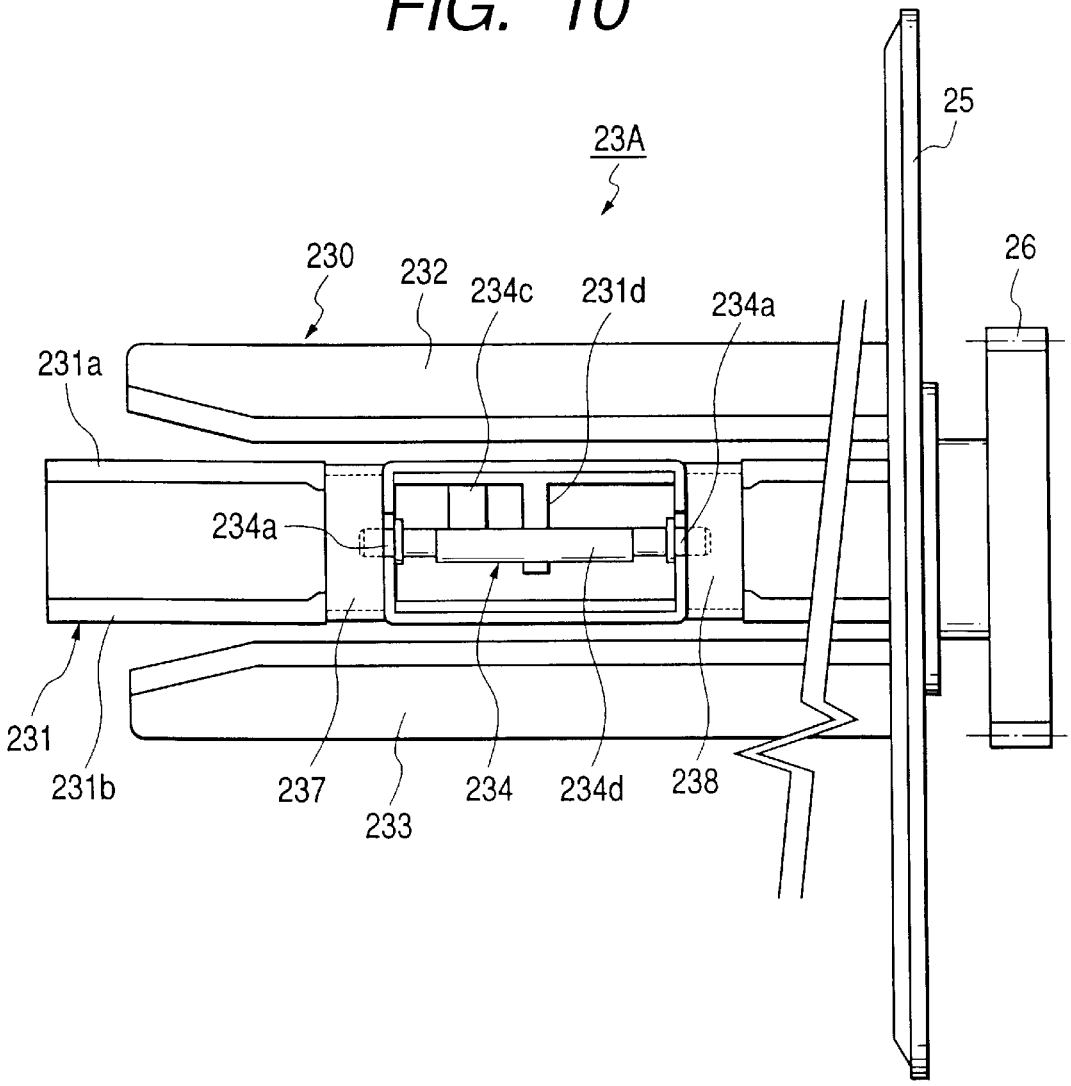
FIG. 10 is a detailed plan view of the outer appearance of a second embodiment of a winding shaft according to the present invention.
Figure 11:
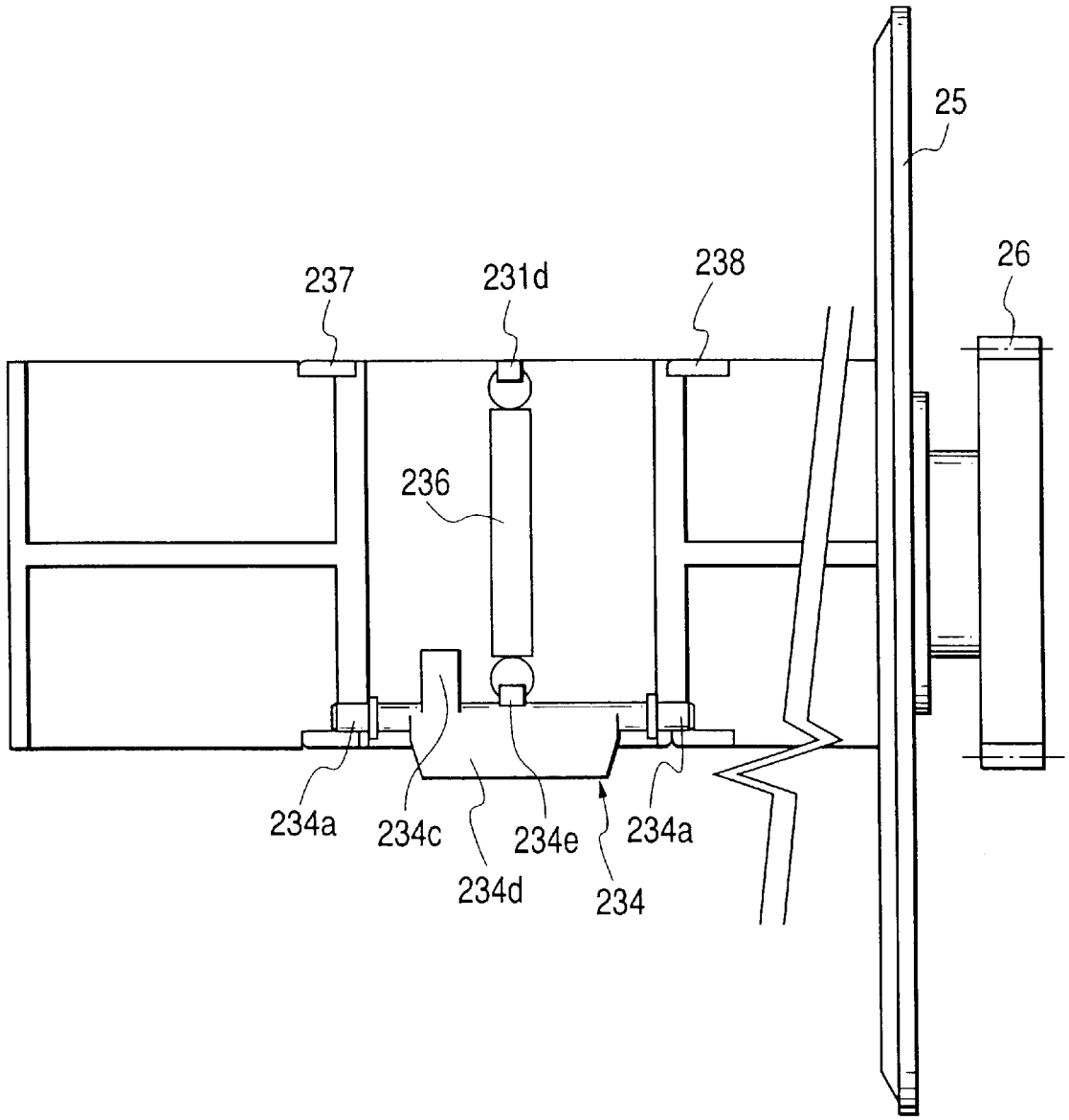
FIG. 11 is a schematic view of the internal structure of the second embodiment of the winding shaft.
Figure 12:
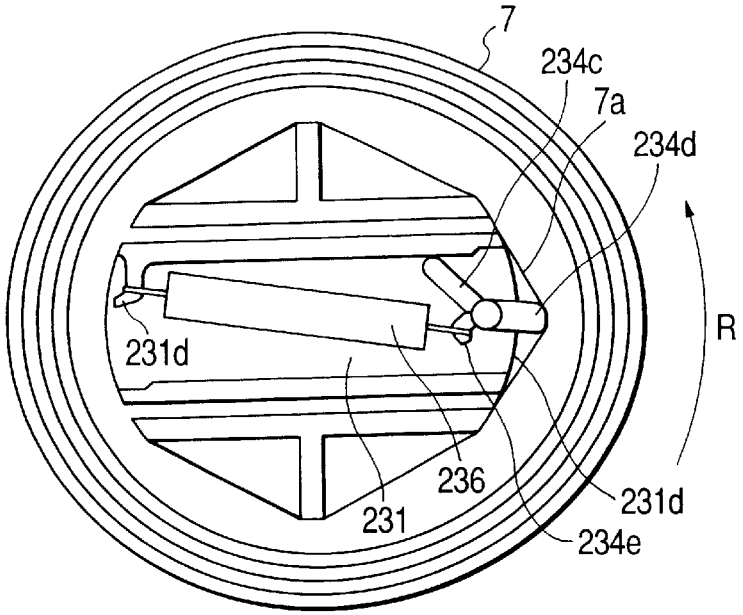
FIG. 12 is an explanatory view of the principle operation of the second embodiment of the winding shaft.

FIGS. 10 to 12 illustrate a second embodiment of a winding shaft according to the present invention. In particular, FIG. 10 is a plan view of the outer appearance of the present embodiment, FIG. 11 is a schematic view of the internal structure of the present embodiment, and FIG. 12 is an explanatory view of the principle operation of the present embodiment. In the following description, parts corresponding to those in the above-mentioned first embodiment are given the same designations, and thus duplicate descriptions thereof are omitted.

As shown in FIGS. 10 to 12, in a winding shaft 23A according to the present embodiment, there is disposed a support-removing member 234, which is similar in structure to the above-mentioned first embodiment.

In the present embodiment, the support-removing member 234 is supported on one side portion of the shaft main body 231 in such a manner that it can be freely rotated about its support shaft 234*a*. Additionally, a tension-coiled spring 236 is bridgingly disposed between a pawl portion 234*e* of the support-removing member 234 and a pawl portion 231*d* formed in the other side portion of the shaft main body 231.

The method of removing the recording paper 7 from the winding shaft 23A in the second embodiment is similar to that of the first embodiment. That is, the winding shaft 23A is first removed from the printer 1, and the recording paper 7 is then gripped by hand and rotated lightly in the opposite direction (arrow R direction) to the winding direction. The support-removing member 234 is then caused to fall down in the arrow R direction due to an external force (friction force) from the innermost peripheral portion 7*a* of the recording paper 7. See FIG. 12. As a result, the innermost peripheral portion 7*a* of the recording paper 7 wound around the winding shaft portion 230 is caused to float from the outer peripheral surface 231*d* of the shaft main body 231. That is, the recording paper 7*a* is loosened with respect to the outer peripheral surface 231*d*, so that the wound recording paper 7 can be easily removed from the winding shaft 23A.

The present embodiment has an advantage in that the winding shaft is simpler in structure than the winding shaft employed in the first embodiment. While the first embodiment requires two support-removing members 234 and 235, the second embodiment only requires one support-removing member 234. The other remaining portions of the structure and operation effects are the same as those of the first embodiment, and thus detailed descriptions thereof are omitted here.

Figure 13:
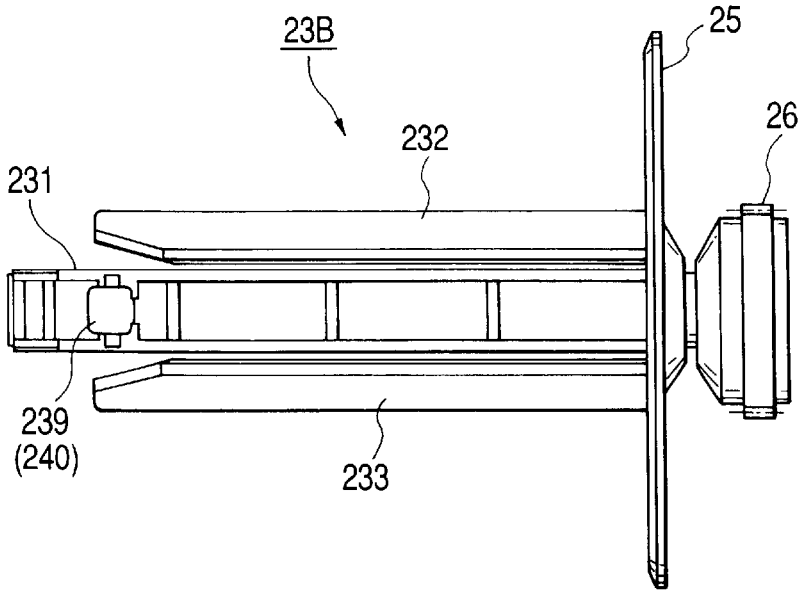
FIG. 13 is a detailed plan view of the outer appearance of a third embodiment of a winding shaft according to the present invention.
Figure 14:
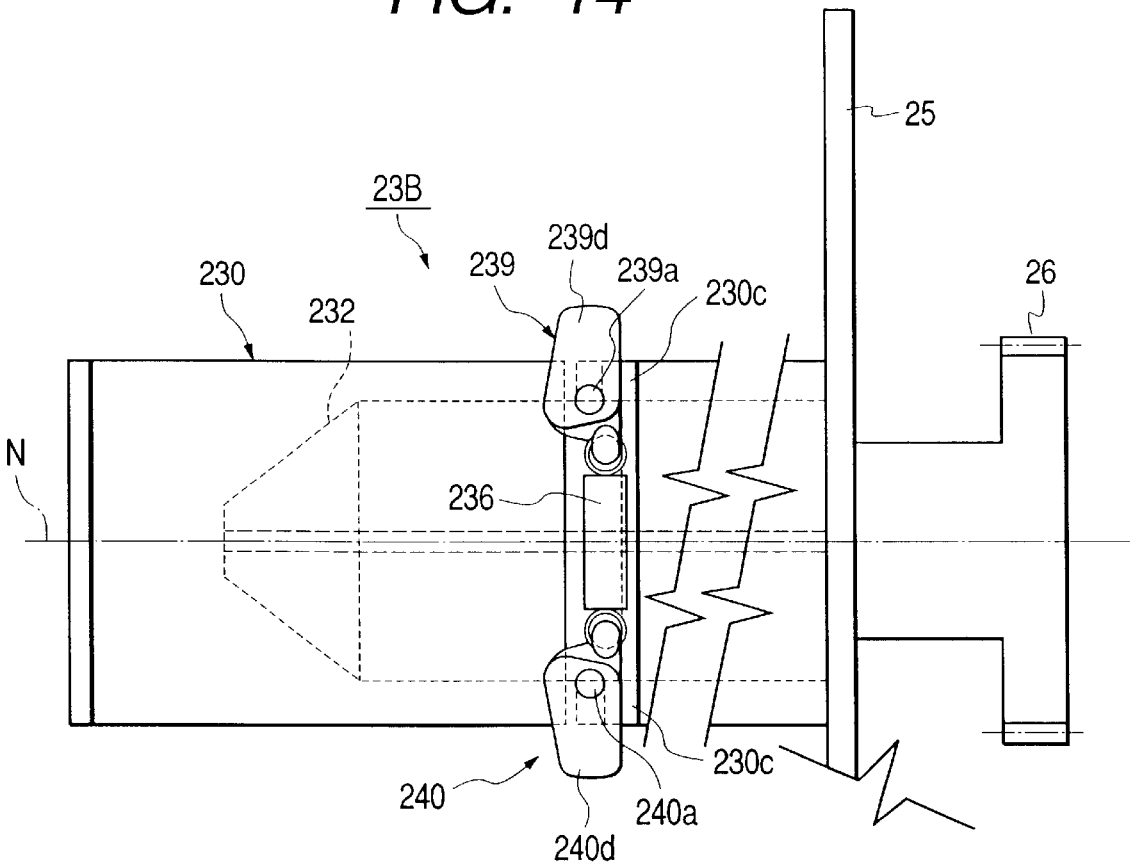
FIG. 14 is a front structure view of the main portions of the third embodiment of the winding shaft.
Figure 15:
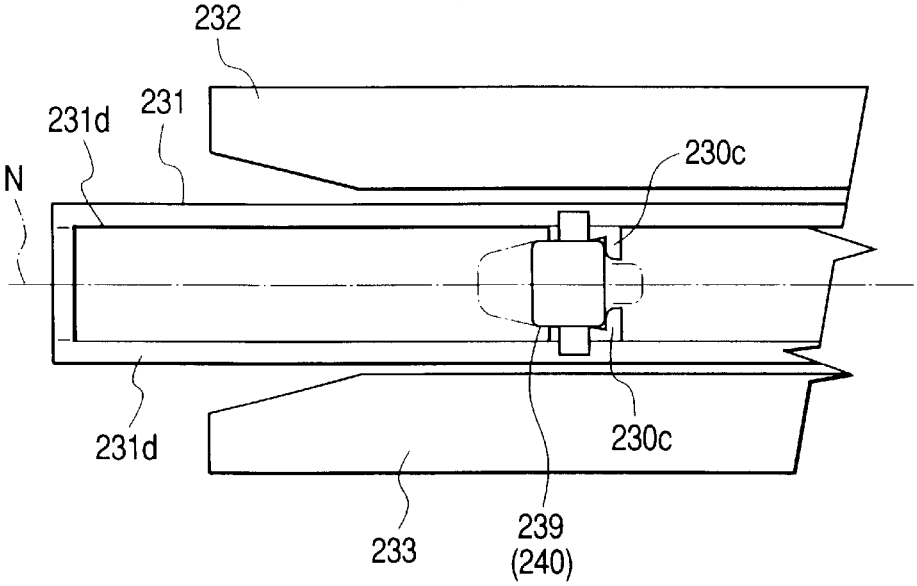
FIG. 15 is a detailed plan view of the structure of the main portions of the third embodiment of the winding shaft.
Figure 16A:
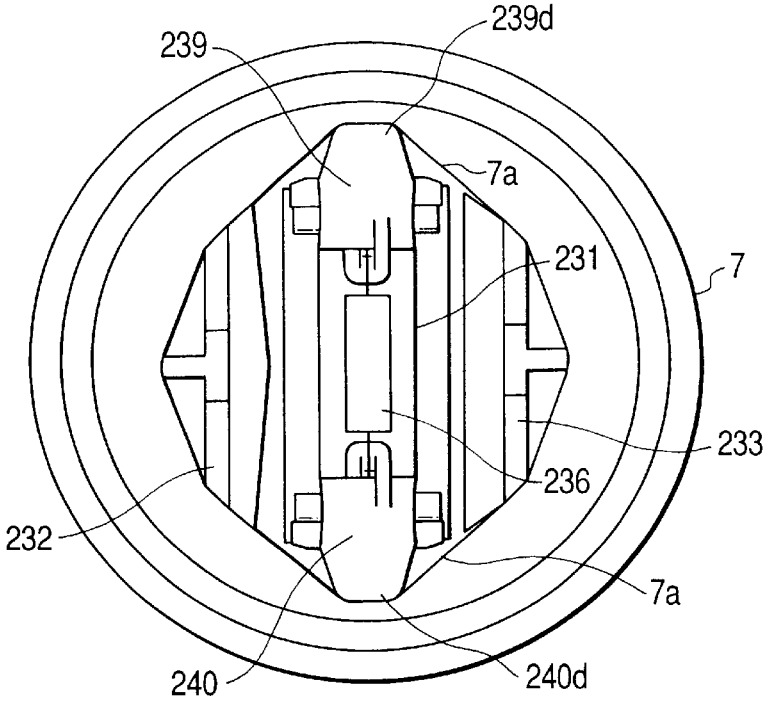
FIG. 16A is an explanatory view of the principle operation of the third embodiment of the winding shaft, showing a state thereof in which the recording paper is wound around the present winding shaft.
Figure 16B:
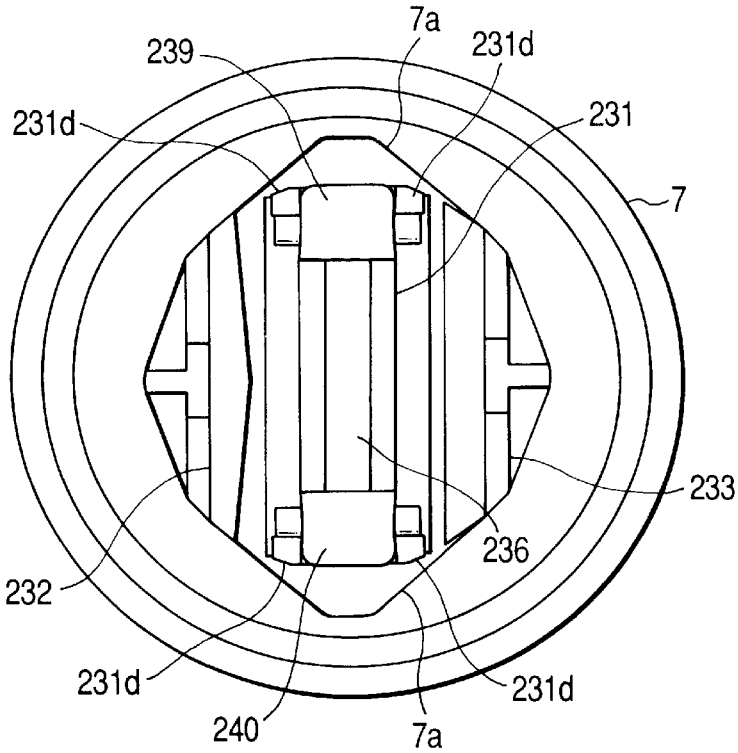
FIG. 16B is an explanatory view of the principle operation of the third embodiment of the winding shaft, showing a state thereof in which the support-removing members are brought down.
Figure 17:
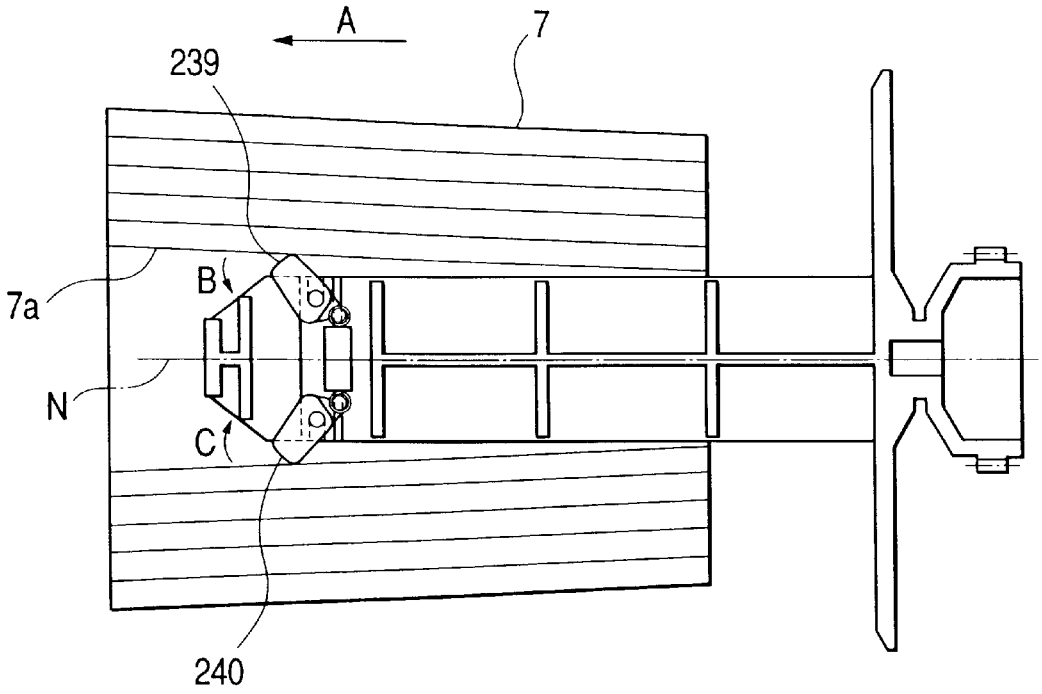
FIG. 17 is an explanatory view of the principle operation of the third embodiment of the winding shaft, showing a state thereof in which the support-removing members are brought down.

FIGS. 13 to 17 illustrate a third embodiment of a winding shaft according to the present invention. FIG. 13 is a plan view of the third embodiment. FIG. 14 is a structural front view of the main portions of the third embodiment. FIG. 15 is a plan view of the main portions of the third embodiment. FIG. 16A is an explanatory view of the principle operation of the third embodiment. FIGS. 16B and 17 are respectively explanatory views of the principle operation of the third embodiment, showing a state thereof in which a support-removing member is brought down. In the following description, parts corresponding to those employed in the previously described first and second embodiments are given the same designations, and thus the detailed descriptions thereof are omitted here.

In the present embodiment, there are disposed a pair of support-removing members 239 and 240 that are structured so as to fall down in the axis direction N of the winding shaft 23B. As shown in FIG. 14, the pair of support-removing members 239 and 240 are respectively supported on the upper and lower portions of the shaft main body 231 in such a manner that they can be freely rotated about their respective support shafts 239*a* and 240*a*. Between the two support-removing members 239 and 240, there is provided or bridged a tension-coiled spring 236. When there is no external force applied to the two support-removing members 239 and 240, the spring 236 causes the two support-removing members 239 and 240 to stand up and the respective support portions 239*d* and 240*d* of the two support-removing members 239 and 240 to project out from the side portions of the shaft main body 231.

As shown in FIG. 14, in order to secure the side portions of the two support-removing members 239 and 240, there are formed portions 230*c* in the winding shaft 23B. As a result, the two support-removing members 239 and 240 are respectively allowed to fall down only in the recording paper 7 removing direction (directions of arrows B and C shown in FIG. 17) from their respective stand-up states shown in FIG. 16A.

According to the present embodiment having the above structure, when winding the recording paper 7, as shown in FIG. 16A, the recording paper 7 can be wound around the winding shaft 23B in such a state that the two support-removing members 239 and 240 respectively stand up. That is, the respective support portions 239*d* and 240*d* of the two support-removing members 239 and 240 project out from the shaft main body 231.

When the recording paper 7 is to be removed from the winding shaft 23B, the winding shaft 23B is first removed from the printer 1. The recording paper 7 is then gripped by hand and rotated lightly in the leading end direction (arrow A direction) of the shaft main body 231. An external force from the innermost peripheral portion 7*a* of the recording paper 7 then causes the two support-removing members 239 and 240 to fall down in the arrow A direction. See FIGS. 16(*b*) and 17. As a result, the innermost peripheral recording paper 7*a* wound around the winding shaft portion 230 is caused to float from the outer peripheral surface 231*d* of the shaft main body 231. That is, the recording paper 7*a* is loosened with respect to the outer peripheral surface 231*d* and, therefore, similarly to the previously described first and second embodiments, the wound recording paper 7 can be easily removed from the winding shaft 23B. The other remaining portions of the structure and operation effects of the present embodiment are the same as those of the first and second embodiments, and thus detailed descriptions thereof are omitted here.

Figure 18:
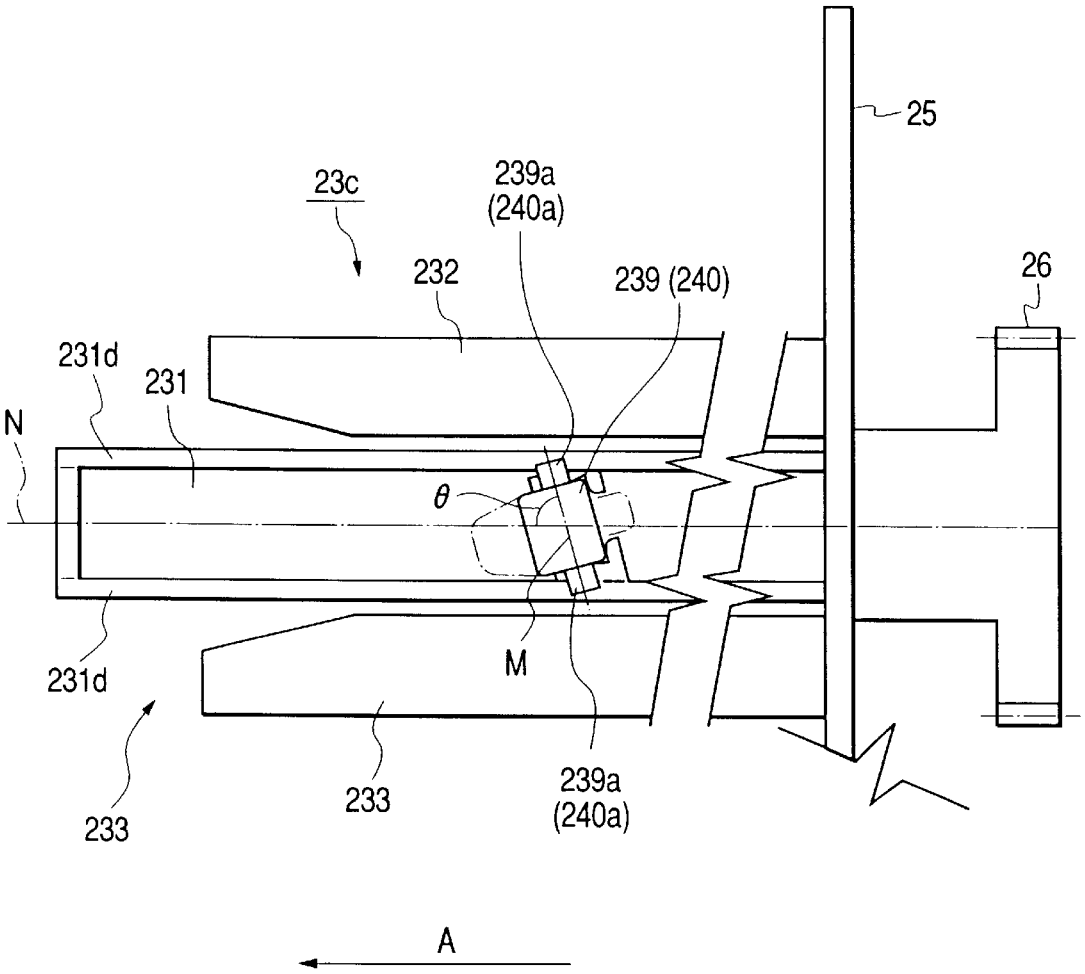
FIG. 18 is a plan structure view of the main portions of a fourth embodiment of a winding shaft according to the present invention.

FIG. 18 is a structural plan view of the main portions of a fourth embodiment of a winding shaft according to the present invention. In the following description, parts corresponding to those employed in the previously described first, second and third embodiments are given the same designations, and thus detailed descriptions thereof are omitted here.

As shown in FIG. 18, a winding shaft 23C according to the fourth embodiment is structured such that the support-removing member 239 of the third embodiment is inclined at a given angle with respect to the axis N direction of the shaft main body. Here, the respective support-removing members 239 and 240, similarly to the above-mentioned third embodiment, are supported on the upper and lower portions of the shaft main body 231 in such a manner that they can be freely rotated about their respective support shafts 239*a* and 240*a*.

In the present embodiment, the angle of inclination of the respective support-removing members 239 and 240 may preferably be set in such a manner that an angle θ formed between the axis N and the rotary axis of the support shafts 239*a* and 240*a* is about 45°. See FIG. 18.

When removing the recording paper 7 from the winding shaft 23C having the structure of the present embodiment, the winding shaft 23C is first removed from the printer 1. The recording paper 7 may then be gripped by hand and rotated lightly in the direction opposite to the recording paper winding direction. Alternatively, the recording paper 7 may be pulled toward the leading end direction (arrow A direction in FIG. 18) of the shaft main body 231. As a result, an external force applied from the innermost peripheral recording paper 7*a* causes the respective support-removing members 239 and 240 to fall down, so that the innermost peripheral recording paper 7*a* wound around the winding shaft portion 231 floats from the outer peripheral surface 231*d* of the shaft main body 231. That is, the recording paper 7*a* is loosened with respect to the outer peripheral surface 231*d* of the shaft main body 231 (see FIG. 16B), and therefore, similarly to the first, second and third embodiments, the recording paper 7 can be easily removed from the winding shaft 23. The other remaining portions of the structure and operation effects of the present embodiment are the same as those of the first and second embodiments, and thus detailed descriptions thereof are omitted here.

Figure 19:
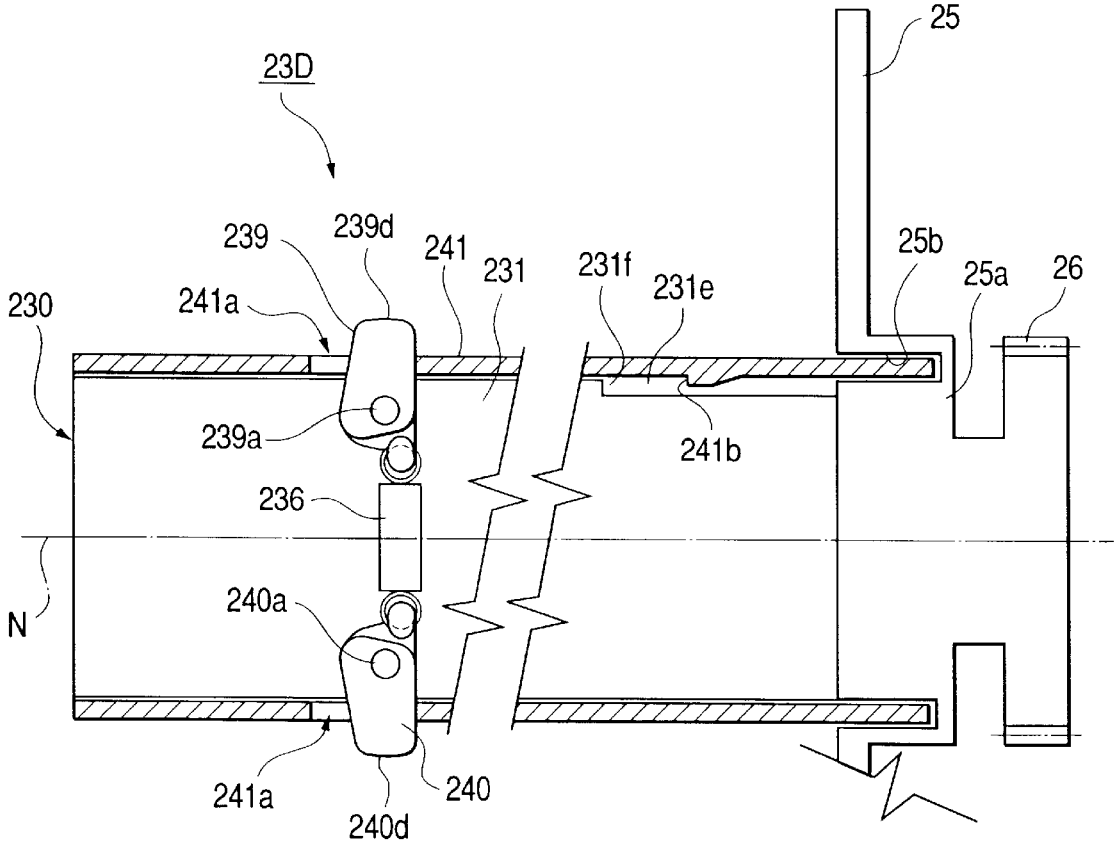
FIG. 19 is a partial section view of the main portions of a fifth embodiment of a winding shaft according to the present invention, when viewed from the front surface direction thereof.
Figure 20:
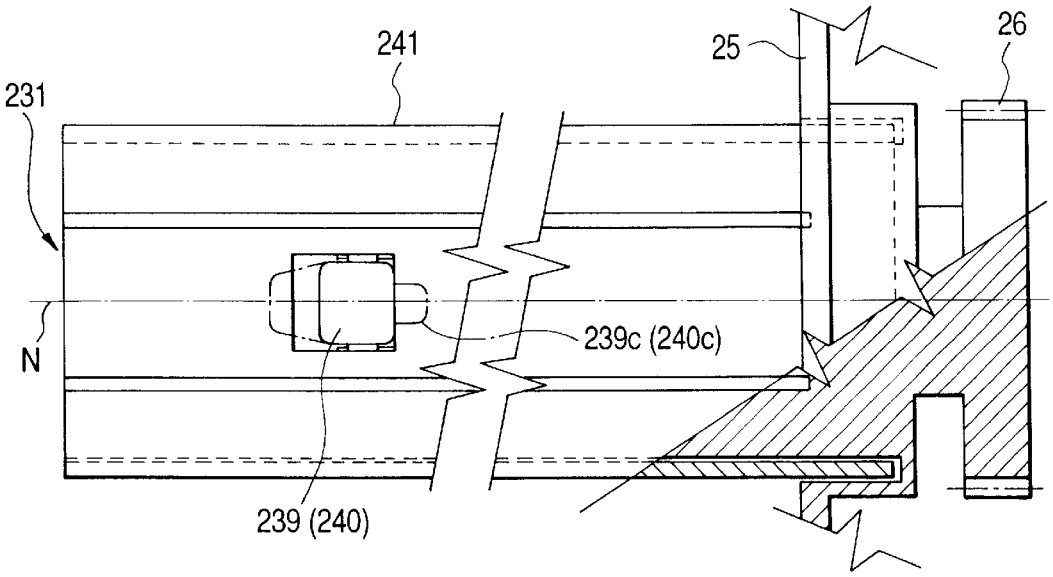
FIG. 20 is a partial section view of the main portions of the fifth embodiment of the winding shaft, when viewed from the plan direction thereof.
Figure 21:
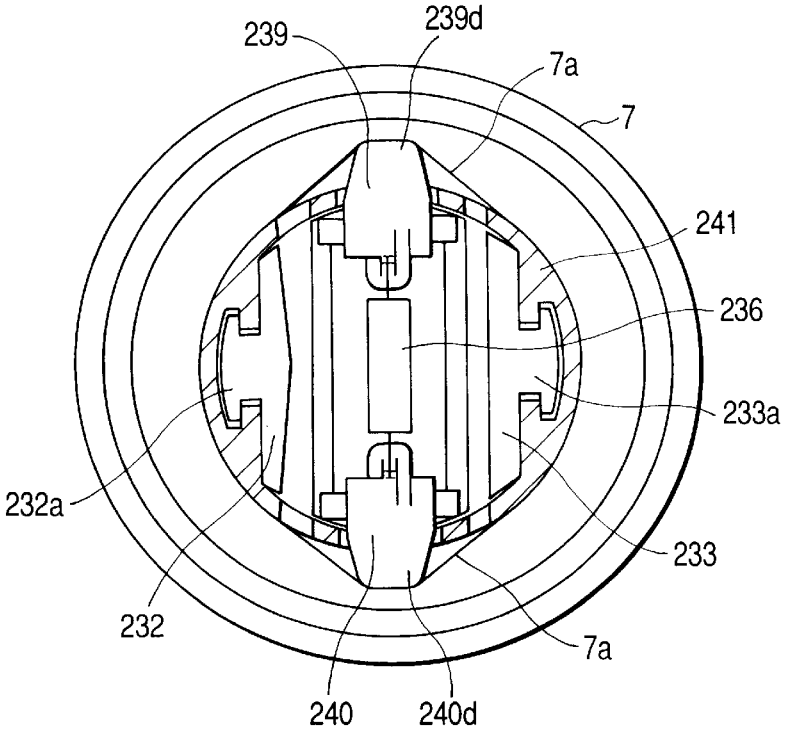
FIG. 21 is an explanatory view of the principle operation of the fifth embodiment of the winding shaft, showing a state thereof in which the recording paper is wound around the present winding shaft.
Figure 22:
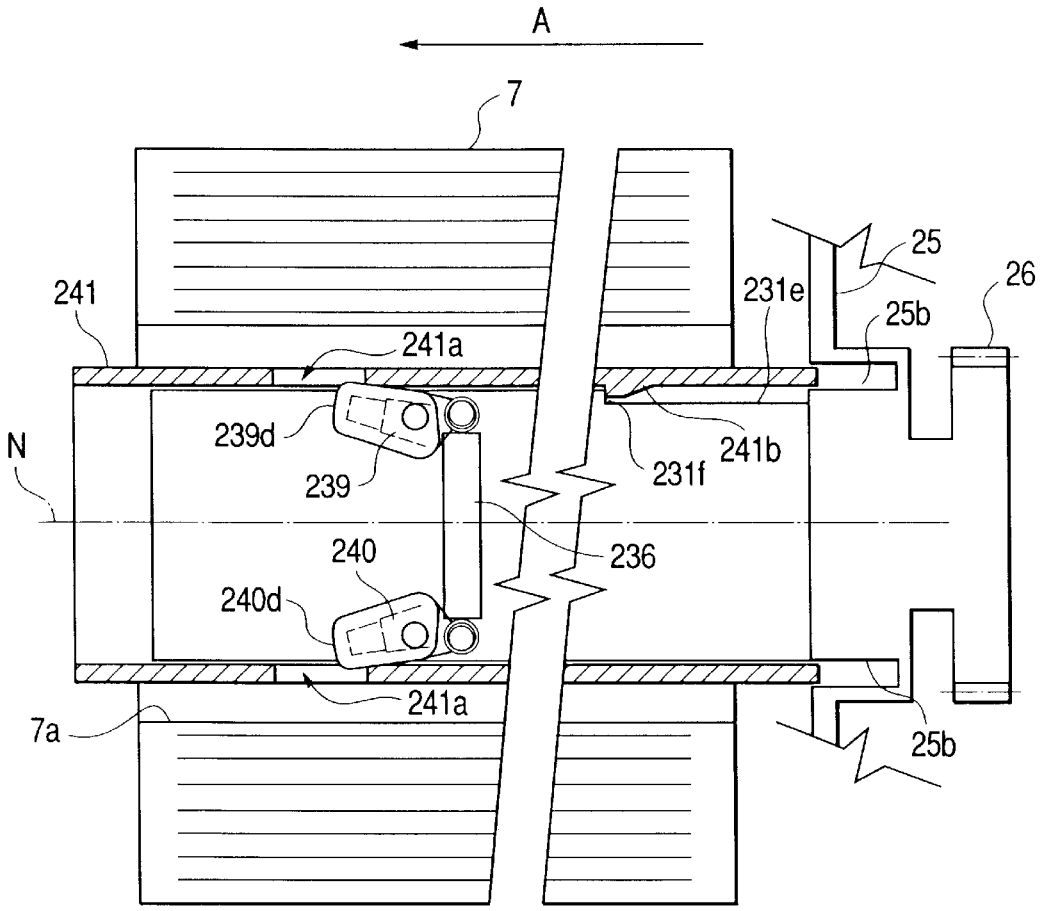
FIG. 22 is an explanatory view of the principle operation of the fifth embodiment of the winding shaft, showing a state thereof in which the support-removing members are brought down.

FIGS. 19 to 22 illustrate a fifth embodiment of a winding shaft according to the present invention. FIG. 19 is a partial section view of the main portions of the present embodiment, when viewed from the front surface direction thereof. FIG. 20 is a partial section view of the main portions of the present embodiment, when viewed from the plane surface direction thereof. FIG. 21 is an explanatory view of the principle operation of the present embodiment, showing a state thereof in which the recording paper is wound around the present winding shaft. FIG. 22 is an explanatory view of the principle operation of the present embodiment, showing a state thereof in which the support-removing members are brought down. In the following description, parts corresponding to those employed in the previously described first, second, third and fourth embodiments are given the same designations, and thus the detailed descriptions thereof are omitted here.

As shown in FIG. 19, in a winding shaft 23D according to the fifth embodiment, a pair of support-removing members 239 and 240 are disposed in the upper and lower portions of the shaft main body 231 thereof. As in the third embodiment, the support-removing members 239 and 240 are formed so as to fall down in the recording paper 7 removing direction. A sleeve-shaped operation member 241 is fitted with the periphery of a winding shaft portion 230, which is composed of a pair of winding portions 232 and 233. Meanwhile, the respective support portions 239*d* and 240*d* of the two support-removing members 239 and 240 project out of the operation member 241 from the hole portions 241*a* respectively formed at positions respectively corresponding to the two support-removing members 239 and 240.

As shown in FIGS. 19 and 21, the operation member 241 is structured such that the leading end portion thereof can be fitted within a groove portion 25*b* formed in the base portion 25*a* of a winding flange 25. The leading end portion of the operation member 241 can also be slid in the shaft main body 230 axis N direction along two guide portions 232*a* and 233*a* respectively formed in the two winding portions 232 and 233. Also, in the inner peripheral surface of the operation member 241, there is formed a securing projection 241*b*. More specifically, as shown in FIG. 21, the operation member 241 is prevented from slipping off the shaft main body 231 due to engagement between the securing projection 241*b* and the wall portion 231*f* of a securing groove 231*e* formed in the shaft main body 231.

In the present embodiment having the above structure, the recording paper 7 can be wound around the winding shaft 23D in such a state that the respective support portions 239*d* and 240*d* of the two support-removing members 239 and 240 project out from the operation member 241. See FIG. 21. As a result, the recording paper 7 can be wound around the operation member 241 in such a state that the recording paper 7 is supported on the respective support portions 239*d* and 240*d* of the two support-removing members 239 and 240.

When the recording paper 7 is to be removed from the winding shaft 23D, the winding shaft 23D is first removed from the printer 1. Next, the recording paper 7 is gripped by hand and pulled in the leading end direction (arrow A direction) of the shaft main body 231. The operation member 241 is then caused to move due to an external force from the innermost peripheral recording paper 7*a*. See FIG. 22. Also, the two support-removing members 239 and 240 are caused to fall down in the same direction, that is, in the arrow A direction, due to the movements of both the recording paper 7*a* and operation member 241. Since the two support-removing members 239 and 240 are pressed against the opening end portions of the hole portions 241 a of the operation member 241, they are caused to enter the inside portion of the operation member 241. As a result, the innermost peripheral recording paper 7*a* wound around the operation member 241 is caused to float from the outer periphery of the operation member 241. That is, the recording paper 7*a* is loosened with respect to the outer periphery of the operation member 241. Therefore, similarly to the first, second, third and fourth embodiments, the recording paper 7 can easily be removed from the winding shaft 23D.

In the present embodiment, when removing the recording paper 7, since the operation member 241 is moved together with the recording paper 7, external forces are applied to the two support-removing members 239 and 240 not only from the recording paper 7, but also from the operation member 241. As a result, the two support-removing members 239 and 240 can be moved more smoothly to thereby loosen the recording paper 7 more positively, which can further enhance the efficiency of the recording paper removing operation. The other remaining portions of the structure and operation effects of the present embodiment are the same as those of the first, second, third and fourth embodiments, and thus the detailed descriptions thereof are omitted here.

As described above, according to the present embodiment, the recording paper 7 can be easily removed from the winding shaft 23D by executing a simple operation. That is, if the recording paper 7 wound around the winding shaft 23D either is simply rotated in the circumferential direction of the winding shaft 23D or is simply pulled in the axis N direction, then the recording paper 7 can be easily removed from the winding shaft 23D.

Figure 23:
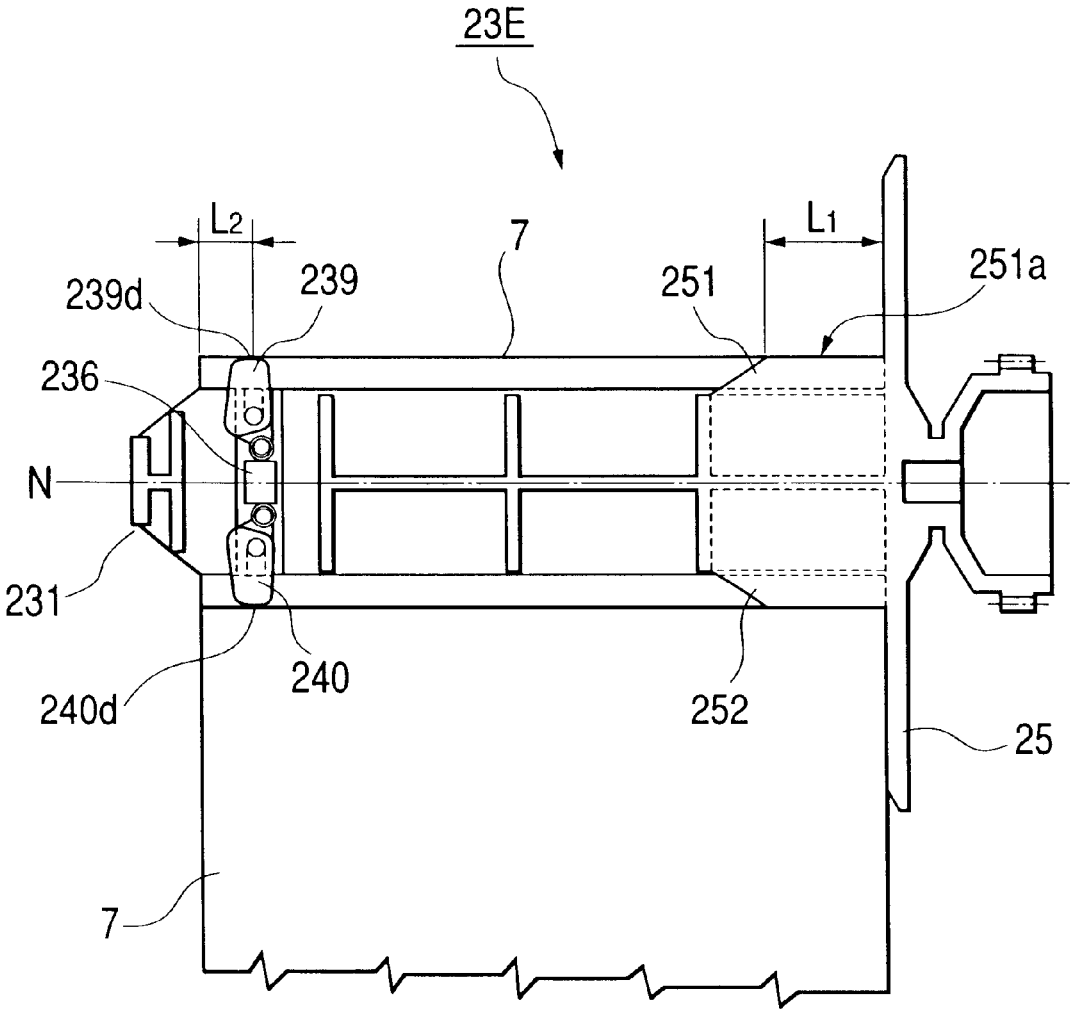
FIG. 23 is a front section view of the outer appearance of a sixth embodiment of a winding shaft according to the present invention.

FIG. 23 illustrates a sixth embodiment of a winding shaft according to present invention. In particular, FIG. 23 is a front section view of a winding shaft according to the sixth embodiment. In the following description, parts corresponding to those employed in the previously described first, second, third, fourth and fifth embodiments are given the same designations, and thus detailed descriptions thereof are omitted here.

As shown in FIG. 23, in the winding shaft 23E according to the present embodiment, support-removing members 239 and 240 are disposed in the upper and lower portions of the shaft main body 231, and are located on the side opposite the winding flange 25. Similarly to the previously described third embodiment, the support-removing members 239 and 240 are structured so as to fall down in the winding shaft 23E axis N direction, which is the recording paper 7 removing direction. Additionally, two recording paper support portions 251 and 252 disposed on the winding flange 25 side, are respectively integrally formed with the winding shaft 23E, and have an outside diameter substantially equal to the outside diameter of the support-removing members 239 and 240 at their respective first positions.

According to the present embodiment, the recording paper 7 is wound around the winding shaft 23E in such a manner that the recording paper 7 extends between support portions 239*d*, 240*d* of the support-removing members 239, 240 and the recording paper support portions 251, 252. Also the recording paper 7 is wound almost in parallel to the axis N of the winding shaft 23E.

When removing the recording paper 7 from the winding shaft 23E, the winding shaft 23E is first removed from the printer 1. Since the support-removing members 239 and 240 are disposed in a manner similar to the previously described third embodiment, the support-removing members 239 and 240 are brought down in the manner shown in FIG. 17. As a result, the recording paper 7 can be removed such that the side end portions of the recording paper after being wound are prevented from being shaped like bamboo shoots. Since it is necessary to move the wound recording paper 7 until the respective support-removing members are brought down, the structure according to the third embodiment is suitable when the recording paper 7 is moved in the winding shaft axis N direction. The winding shaft axis N direction is the same direction as the recording paper support portions.

When the paper width of the recording paper 7 is 90 mm or less, preferably, the length L1 of the recording paper support portions 251 and 252 in the axis direction thereof may be set to 15 mm or less. The shorter the length L1, the more enhanced the efficiency of removing the recording paper 7 from the winding shaft 23E. However, if the paper width is large, then it is difficult to wind the recording paper 7 in parallel to the axis of the winding shaft. Also, the length L2. of the support-removing members 239 and 240 of the present embodiment from the other end portion of the recording paper 7 is set to be approximately 10 mm. According to the present embodiment, the recording paper support portions 251 and 252 are formed to be in contact with the winding flange 25, but this is not limitative. For example, the recording paper support portions 251 and 252 may also be formed apart from the winding flange 25. Especially when the paper width of the recording paper 7 is increased, the distance between the support-removing members 239 and 240 is lengthened, which can make it impossible to wind the recording paper 7 in parallel to the axis N of the winding shaft 23E. In such a case, the positions of the support-removing members 239 and 240 are moved to thereby balance them such that the recording paper 7 can be wound around the winding shaft in parallel to the axis of the winding shaft. However, if the recording paper support portions are formed apart from the winding flange 25, then the need to increase the length of the respective contact portions 251*a* of the recording paper support portions that can be contacted with the recording paper 7 is eliminated. As a result, the efficiency of removing the recording paper 7 from the winding shaft can be prevented from being greatly lowered.

Figure 24:
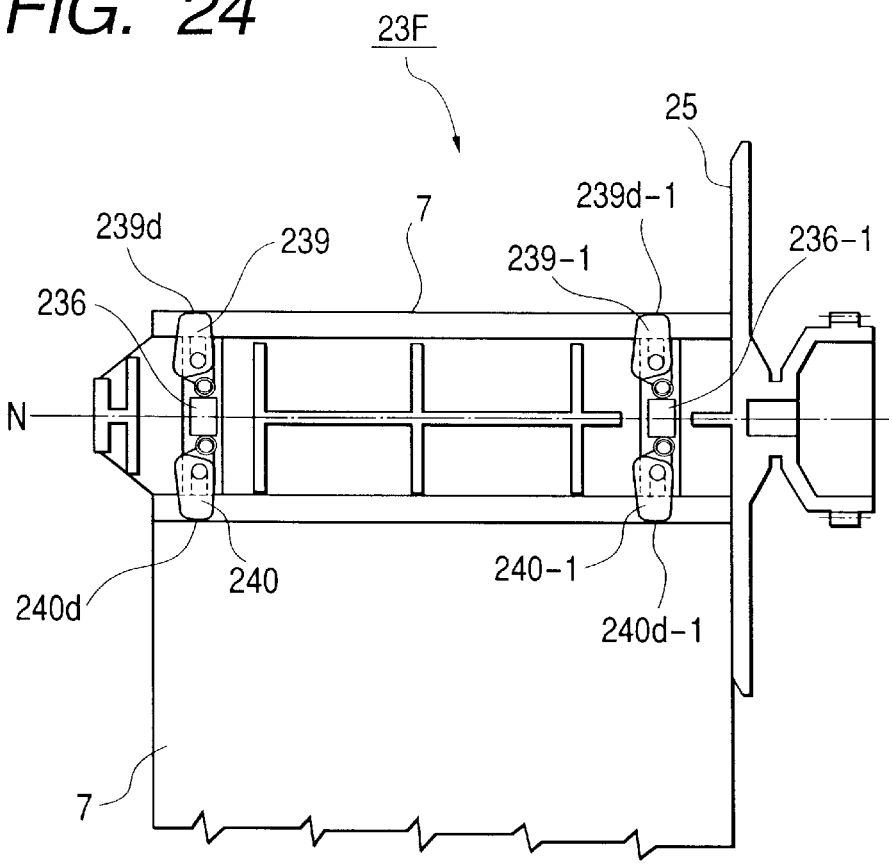
FIG. 24 is a front section view of the outer appearance of a seventh embodiment of a winding shaft according to the present invention.
Figure 25:
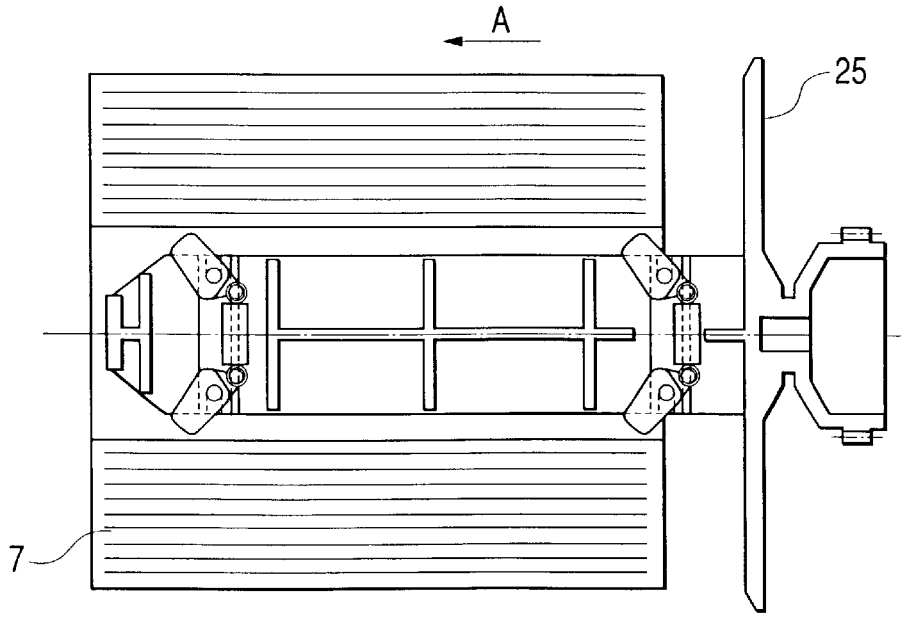
FIG. 25 is an explanatory view of the principle operation of the seventh embodiment of the winding shaft, showing a state thereof in which the support-removing members are brought down.

FIGS. 24 and 25 illustrate a seventh embodiment of a winding shaft according to the present invention. In particular, FIG. 24 is a front section view of a winding shaft according to the present embodiment, and FIG. 25 is an explanatory view of the principle operation of the present embodiment, showing a state thereof in which the support-removing members are brought down. In the following description, parts corresponding to those employed in the previously described first, second, third, fourth, fifth and sixth embodiments are given the same designations, and thus the duplicated descriptions thereof are omitted here.

As shown in FIGS. 24 and 25, support-removing members 239 and 240 are disposed in the winding shaft 23F in the upper and lower portions of the shaft main body 231 on the winding flange 25 side thereof. These support-removing members 239 and 240 are similar to the previously described third embodiment in that they are structured so as to fall down in the winding shaft 23F axis N direction which is the recording paper 7 removing direction. Additional support-removing members 239-1 and 240-1 are disposed on the opposite side of the winding flange 25, and similarly to the previously described third embodiment, are structured so as to fall down in the winding shaft 23F axis N direction, which is the recording paper 7 removing direction.

According to the present embodiment as shown in FIG. 24, the recording paper 7 is wound around the winding shaft 23F in such a manner that the recording paper 7 extends between the support portions 239*d* and 239*d*-1 of the support-removing member 239. The recording paper 7 also extends between 240*d* and 240*d*-1 of the support-removing member 240. Additionally, the recording paper 7 is wound almost in parallel to the axis N of the winding shaft 23F. The wound state of the recording paper according to the present embodiment is the same as the previously described sixth embodiment. However, because the support-removing members are also disposed on the winding flange 25 side, when removing the wound recording paper 7 from the winding shaft 23F (which has been removed from the printer 1), the support-removing members are caused to fall down as shown in FIG. 25. As a result, the recording paper 7 can be removed in such a manner that the side end portions of the recording paper 7 after being wound are prevented from being shaped like bamboo shoots. Therefore, the efficiency of removing the recording paper can be enhanced even further than as in the previously described sixth embodiment.

The other remaining portions of the structure and operation effects of the present embodiment are the same as those of the previously described respective embodiments, and thus detailed descriptions thereof are omitted here.

The present invention is not limited to the respective embodiments described herein. Various changes and modifications may be made thereto without departing from the scope and spirit of the patent claims. For example, the above-mentioned sleeve-shaped operation member can be used not only when, as in the fifth embodiment, the support-removing members are brought down in the axis direction, but also when the support-removing members are brought down in the circumferential direction of the winding shaft. The sleeve-shaped operation member may also be used when the support-removing members are brought down in an inclined direction with respect to the axis of the winding shaft.

Also, in the illustrated embodiments, the support-removing members are rotated and are thereby brought down, so that the winding diameter of the recording paper can be reduced. However, the invention is not limited to this. For example, the support-removing members can also be slid due to an external force used to remove the recording paper.

Further, in the illustrated embodiments, description has been given of a winding shaft of a type that it is supported in a cantilevered manner. However, the invention is not limited to this. For example, the invention can also apply to a winding shaft of a type that the two ends thereof are supported, and to a winding shaft of a type that includes two winding flanges provided on both sides thereof. However, it should be noted here that the invention can provide the best effect when the winding shaft is supported in a cantilevered manner, as in the illustrated embodiments of the invention.

Figure 27:
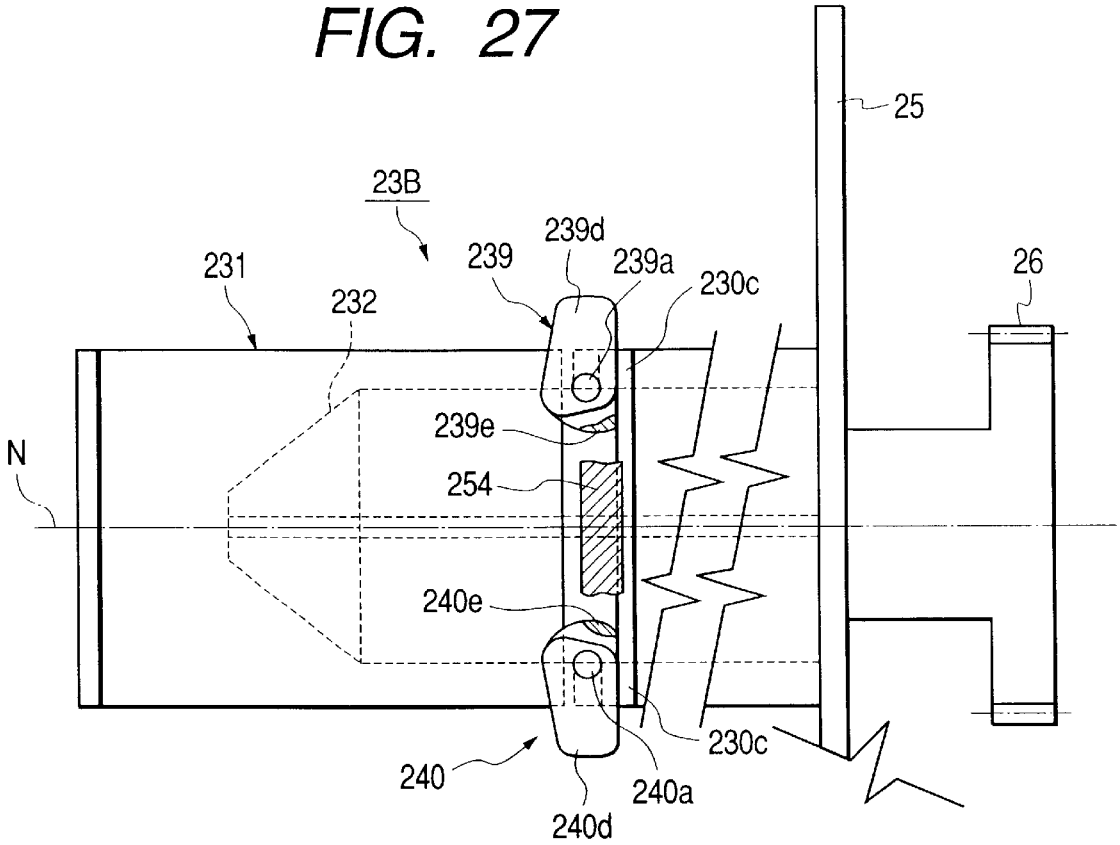
FIG. 27 is a front structure view of the main portions of the other embodiment of the winding shaft in which iron pieces and a magnet are used instead of the coil spring.

Still further, in the illustrated embodiments, description has been given on the assumption that a spring used therein is a coiled spring. However, a plate spring can also be used. Further, instead of the spring, iron pieces 239*e* and 240*e* may be buried on each bottom portion of the two support-removing members 239 and 240, and a magnet 254 may be attached on the shaft main body 231 as shown in FIG. 27. In this embodiment, the support-removing members 239 and 240 are attracted by the magnet 254 and the support-removing members 239 and 240 are caused to stand up when no external force is applied to the support-removing members 239 and 240. When the recording paper is to be removed from the winding shaft 23B, the support-removing members 239 and 240 are caused fall down as aforementioned.

Figure 28A:
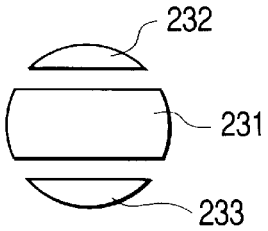
FIGS. 28A to 28D are schematic sectional views of the modified embodiments of the winding shaft according to the present invention.
Figure 28B:
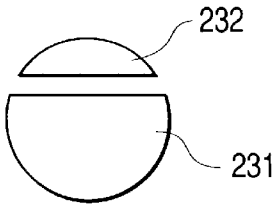
Figure 28C:
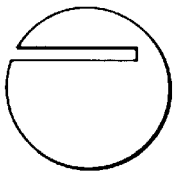
Figure 28D:
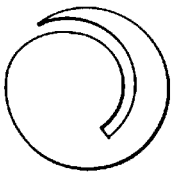

Still further, in the illustrated embodiments, description has been given regarding the types of the winding shaft that the shaft main body 231 is sandwiched by a pair of winding portions 232 and 233 as shown in a schematic sectional view FIG. 28A. However, the present invention is not limited to this. For example, only one winding portion 232 can be applied to the winding shaft as shown in FIG. 28B. Further, the shaft main body and winding portion can be integrally formed as shown in FIGS. 28C and 28D.

Yet still further, the invention can apply not only to a dot impact printer, but also to other various kinds of printers such as a thermal printer, an ink jet printer and the like.

Still further, in the illustrated embodiments, description has been given on the assumption that a spring used therein is a coiled spring. However, a plate spring can also be used.

What is claimed is:

1. A printer comprising:

a print head for printing a recording medium;

a paper feed mechanism for feeding said recording medium;

a winding shaft; and a winding mechanism for enabling said recording medium fed by said paper feed mechanism to be wound around said winding shaft, wherein said winding shaft comprises:

a winding shaft portion for winding said recording medium therearound;

a support-removing member disposed on said winding shaft portion and moveable between a first position and a second position, said first position being located beyond an outer periphery of said winding shaft portion and said second position being located nearer to an axis of said winding shaft portion than said first position, wherein said support-removing member is movably supported on said winding shaft portion, said support-removing member being allowed to move in either one of an axial direction and an outer peripheral direction of said winding shaft portion; and an urging member for urging said support-removing member toward said first position.

2. A winding shaft for winding a recording medium, comprising:

a winding shaft portion for winding said recording medium therearound;

a support-removing member disposed on said winding shaft portion and moveable between a first position and a second position, said first position being located beyond an outer periphery of said winding shaft portion and said second position being located nearer to an axis of said winding shaft portion than said first position, wherein said support-removing member is movably supported on said winding shaft portion, said support-removing member being allowed to move in either one of an axial direction and an outer peripheral direction of said winding shaft portion; and an urging member for urging said support-removing member toward said first position.

3. A winding shaft according to claim 2, further comprising a sleeve disposed on a periphery of said winding shaft portion and being moveable relatively to said winding shaft portion so as to move said support-removing member from said first position to said second position when said sleeve is moved.

4. A winding shaft according to claim 3, wherein said urging member comprises a spring.

5. A winding shaft according to claim 3, wherein the support-removing member is rotatably supported on the winding shaft portion.

6. A winding shaft according to claim 2, wherein said urging member comprises a spring.

7. A winding shaft according to claim 2, further comprising:

a winding flange disposed at one end of said winding shaft portion; and a recording medium support portion disposed on the outer periphery of said winding shaft portion on the side of said winding flange, said support-removing member being disposed thereon on the opposing side of said winding flange, wherein a length of said recording medium support portion from said axis of said winding shaft portion is substantially equal to that of said support-removing member located at said first position.

8. A winding shaft according to claim 7, wherein said recording medium support portion is disposed relative to said support-removing member such that a given line connecting said recording medium support portion and said support-removing member is disposed parallel to said axis of said winding shaft portion.

9. A winding shaft according to claim 7, wherein said recording medium support portion is disposed over at a position corresponding to said axis of said winding shaft portion and at two positions symmetrical with respect to said axis of said winding shaft portion.

10. A winding shaft according to claim 2, wherein said support-removing member comprises a plurality of support-removing members respectively arranged along the axial direction of said winding shaft portion.

11. A winding shaft according to claim 10, wherein said plurality of support-removing members are respectively arranged along the outer peripheral direction of said winding shaft portion, and wherein said support-removing members are disposed symmetrically with respect to said axis of said winding shaft portion to each other.

12. A winding shaft according to claim 2, wherein said support-removing member comprises a plurality of support-removing members respectively arranged along the outer peripheral direction of said winding shaft portion, said support-removing members are disposed symmetrically with respect to said axis of said winding shaft portion to each other.

13. A winding shaft according to claim 2, wherein the support-removing member is rotatably supported on the winding shaft portion.

14. A printer comprising:

a print head for printing a recording medium;

a paper feed mechanism for feeding said recording medium;

a winding shaft; and a winding mechanism for enabling said recording medium fed by said paper feed mechanism to be wound around said winding shaft, wherein said winding shaft comprises:

a winding shaft portion for winding said recording medium therearound; and a support-removing member disposed on said winding shaft portion and moveable between a first position toward which the support-removing member is constantly urged and a second position, said first position being located beyond an outer periphery of said winding shaft portion and said second position being located nearer to an axis of said winding shaft portion than said first position;

wherein said support-removing member is movably supported on said winding shaft portion, said support-removing member being allowed to move in either one of an axial direction and an outer peripheral direction of said winding shaft portion.

15. A printer comprising:

a print head for printing a recording medium;

a paper feed mechanism for feeding said recording medium;

a winding shaft; and a winding mechanism for enabling said recording medium fed by said paper feed mechanism to be wound around said winding shaft, wherein said winding shaft comprises:

a winding shaft portion for winding said recording medium therearound;

a support-removing member disposed on said winding shaft portion and moveable between a first position and a second position in an axial direction of the winding shaft portion, said first position being located beyond an outer periphery of said winding shaft portion and said second position being located nearer to an axis of said winding shaft portion than said first position;

an urging member for urging said support-removing member toward said first position; and a recording medium support portion disposed on the outer periphery of said winding shaft portion at an end of said winding shaft portion, said end being located opposite to a direction in which the support-removing member is moved from the first position to the second position, wherein a length of said recording medium support portion from said axis of said winding shaft portion is substantially equal to that of said support-removing member located at said first position.

16. A winding shaft for winding a recording medium, comprising:

a winding shaft portion for winding said recording medium therearound;

a support-removing member rotatably disposed on said winding shaft portion and moveable between a first position and a second position, said first position being located beyond an outer periphery of said winding shaft portion and said second position being located nearer to an axis of said winding shaft portion than said first portion; and an urging member for constantly urging said support-removing member toward said first position, said urging member acting directly on said support-removing member.

* * * * *